US011619090B1

(12) United States Patent
Shattuck

(10) Patent No.: US 11,619,090 B1
(45) **Date of Patent: *Apr. 4, 2023**

(54) COMPOSITE FENESTRATION ASSEMBLY

(71) Applicant: Steelworks Etc. Inc., Oxnard, CA (US)

(72) Inventor: Robin W. Shattuck, Oxnard, CA (US)

(73) Assignee: Steelworks Etc. Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/867,273

(22) Filed: Jul. 18, 2022

Related U.S. Application Data

(63) Continuation of application No. 17/542,313, filed on Dec. 3, 2021, now Pat. No. 11,391,083.

(51) Int. Cl.

| | |
|---|---|
| ***E06B 1/32*** | (2006.01) |
| ***E06B 1/36*** | (2006.01) |
| ***E06B 3/54*** | (2006.01) |
| *E06B 3/263* | (2006.01) |
| *E06B 3/96* | (2006.01) |

(52) U.S. Cl.
CPC ..... *E06B 1/32* (2013.01); *E06B 1/36* (2013.01); *E06B 3/5481* (2013.01); *E06B 3/9604* (2013.01); *E06B 2003/26392* (2013.01)

(58) Field of Classification Search
CPC .... E06B 1/32; E06B 1/36; E06B 2003/26392; E06B 3/5481; E06B 3/58; E06B 3/5814; E06B 3/60; E06B 3/9604
See application file for complete search history.

(56) References Cited

U.S. PATENT DOCUMENTS

| | | | | |
|---|---|---|---|---|
| 8,484,902 | B1 * | 7/2013 | Brown | E06B 3/26341 49/504 |
| 9,683,402 | B2 * | 6/2017 | Abdul Lathief | E04F 11/1846 |
| 9,725,946 | B1 * | 8/2017 | Vassilev | E06B 3/302 |
| 10,711,457 | B2 * | 7/2020 | Torrabias Cantal | E04B 2/74 |
| 2004/0206025 | A1 * | 10/2004 | Panto | E06B 3/10 52/302.1 |
| 2021/0238911 | A1 * | 8/2021 | Theriault | E06B 3/2605 |
| 2022/0025696 | A1 * | 1/2022 | Dröge | H01Q 1/2283 |

FOREIGN PATENT DOCUMENTS

| | | | | |
|---|---|---|---|---|
| CN | 108204192 | A * | 6/2018 | E06B 1/16 |
| CN | 109519085 | A * | 3/2019 | E06B 1/32 |
| CN | 110130805 | A * | 8/2019 | |
| CN | 111119705 | A * | 5/2020 | |
| CN | 111173405 | A * | 5/2020 | |
| CN | 112112534 | A * | 12/2020 | |
| DE | 29718915 | U1 * | 1/1998 | E06B 3/205 |
| DE | 202004000817 | U1 * | 6/2004 | E06B 1/30 |
| DE | 202018106824 | U1 * | 2/2020 | |
| EP | 1712719 | A1 * | 10/2006 | E06B 3/5828 |
| EP | 3396097 | A1 * | 10/2018 | |
| GB | 1459477 | A * | 12/1976 | E06B 3/5814 |
| GB | 2282630 | A * | 4/1995 | E06B 3/26341 |
| GB | 2451468 | A * | 2/2009 | E06B 3/5409 |

* cited by examiner

*Primary Examiner* — Ryan D Kwiecinski
(74) *Attorney, Agent, or Firm* — Advantage IP Law Firm

(57) ABSTRACT

A composite fenestration assembly having one or more sub-assemblies including at least one glazing border constructed of a first material and a rigid overlay constructed of a second material to cover and protect an exposed surface of the glazing border while maintaining narrow sight lines and providing an architecturally pleasing exterior appearance.

29 Claims, 16 Drawing Sheets

COMPOSITE FENESTRATION ASSEMBLY

CROSS-REFERENCE TO OTHER APPLICATIONS

This application is continuation of co-pending U.S. non-provisional application Ser. No. 17/542,313, now U.S. Pat. No. 11,391,083, filed on Dec. 3, 2021, entitled the same, and which is hereby incorporated by reference in its entirety.

BACKGROUND

1. Field of the Disclosure

The disclosure relates broadly to fenestrations, their manufacture, and their assembly, and more specifically, to composite fenestrations incorporating at least two different materials including one of a ferrous based material.

2. Background

Metal framed windows go back to medieval times long before steel working was an available technology. The metal frames were constructed by metalworkers or blacksmiths from wrought iron, an iron alloy with a low carbon content. These simple metal frames were glazed with either stained glass or clear leaded lights. Where flat sections of wrought iron were used to make up a frame, the leaded light was fixed to the frame with wire secured with lead solder and, later on, a copper rivet was used instead of the wire. The light was further weatherproofed at its junction with the frame using a putty mixture of whiting and linseed oil. The metal frame was then secured to the building. Given the expense of such wrought iron windows and the lack of widespread skill to make them, such windows were mostly incorporated into ecclesiastical buildings and homes of those who could afford them. Wrought iron windows eventually fell out of favor with the rich and fashionable, who adopted timber frames instead, since timber could be carved more ornately and was more readily available. However, religious buildings and those requiring better security retained the metal window look. In addition, the metal frame windows offered a more secure entry point than traditional wooden windows as well as a certain aesthetic.

In the 1800s, all steel window frames were introduced as the Industrial Revolution brought about major advances in hot rolled steel permitting the mass production of steel framed windows. The Industrial Revolution further allowed for window production to take place in a controlled environment allowing for a wider choice of designs and styles. These all steel window frames were typically constructed of flat stock with a channel for receiving a pane of glass and provided an architecturally pleasing exterior appearance due the relatively thin elevational profile and expansive sight lines. These fire-resistant metal frames and sashes became the standard for factories and commercial buildings, as well as for larger residential and university buildings, institutions, prisons, and workhouses. In the first half of the 1900s, the profiles of the metal frame windows continued to expand in number. However, most metal frame windows were typically relatively flat with an exterior nib cooperating with an interior bead to secure a pane of glass to the metal frame. Over time, however, such construction resulted in poor thermal effectivity and were also eventually abandoned in favor of wood framed windows, especially in the single-family residential market. However, the architecturally pleasing aspect of such windows remained desired.

In 1955, hot-dip galvanizing was introduced enhancing the durability and appearance of the steel windows. The popularity of such windows lasted until about the 1970s. However, there has been a recent resurge in the popularity of steel windows given their thinner sight lines allowing for a greater viewing window, their durability, and vintage architectural look.

Steel windows suffer from a few drawbacks, however. The first is that steel is relatively inefficient as an insulator allowing the temperature gradient to transition from the exterior to the interior of the building. As one solution to obtain a more desirable thermal profile, all steel frames may be broken, severed, or split with a non-conductive or lower conductive material inserted between the exterior and interior halves of the frame. While this approach led to a more thermally acceptable solution, there is a cost for the additional manufacturing required to split the metal frames, inserting the insulating material, and then reassembling the frames. In addition, such thermal break window frames tended to stray away from the thin profile of the original windows by introducing thicker window frames in order to accommodate the added insulating material. The cold interior appearance of an all steel frame window is also not generally viewed as desirable compared to a wood or vinyl frame either.

As an early alternative to metal framed windows, the earliest American windows were wood casement windows, hinged at the sides. By the early 1800s, sliding single- and double-hung windows had come into popular use. As opposed to all steel windows, all wooden windows were often used in residential and commercial building practices. Such windows had a vastly improved thermal performance compared to all metal frames. Wood may also be chosen to match the interior of the building, either the flooring, furniture, or walls and generally has a more pleasing warm interior appearance. Wood, however, suffers from significant maintenance issues an requires frequent painting which often involved stripping off the old paint, priming, and then repainting the wooden portions of the window due to the exposure to the outside elements. Such task could be particularly cumbersome if the window were divided into a number of panes such as when muntins were introduced into the window structure. In addition to painting, often the wood was susceptible to rot and had to be replaced. For this reason, following the end of World War II with the increased availability, lower price, and non-corroding properties of aluminum, cladding was introduced into the window market supplanting wood windows as the primary choice of homeowners in the latter part of the $20^{th}$ century, especially given its promise of minimal maintenance. The clad windows were developed to provide a more environmental resistant material on the exterior of the window to extend the life of the window while reducing the maintenance associated with a wood window structure. In other words, the cladding protected the wood from the elements. The dual material windows with clad exterior and wood interior were known as composite windows.

In many cases, the selected cladding material is aluminum, although vinyl, PVC, and fiberglass were also used. Such aluminum cladding took the form of roll-form (coiled or pop can) aluminum or more intricate extruded aluminum. Roll-form aluminum is rolled against the wooden frame components, such as the sash, and positioned directly against the wood. This cladding is easy to install yet fails to perform in respects to durability and water protection as this approach imparts a narrow gap between the aluminum and the sash, that, over time, allows water to seep in and rot the wood, due to minimal air circulation.

As an alternative to roll-form or pop can aluminum, extruded aluminum was introduced. This type of cladding is much thicker, lasts longer and guarantees little to no water damage over time. Extruded aluminum, in contrast to the thin roll-form aluminum, is about the thickness of a quarter and applied at somewhat of a distance from the sash. Both the sash and the frame may be constructed of extruded aluminum, allowing water to pool at the bottom and flow out. Also, because of the intended space between the sash and the cladding, air can easily ventilate that area and prevent the wood from becoming fully saturated. Overall, aluminum-clad windows offer the traditional look of wood while protecting the wood window from harsh weather and damage from insects and decay. In addition, retaining wood as part of the window structure helps keep the cold or heat out to maintain a consistent temperature within the home as wood is a non-conductive material.

In addition, replacing, retrofitting, or upgrading original wood or steel windows with cheaper materials such as aluminum cladding can significantly impact building appearance. Aluminum, for example, is much weaker than steel, requiring bulkier frame profiles that reduce the viewing area and can destroy the delicate look afforded by multi-pane steel windows. Likewise, vinyl may discolor and warp over time, making it a far less durable material over the long term than the original wood. In addition, the aluminum cladding is often extruded into a complicated shape which when placed over the wood counterpart create large air gaps between the wood and the aluminum cladding that often leads to condensation issues.

One solution offered to reduce the bulkier frame profiles introduced by extruded aluminum may be found in U.S. Pat. No. 9,725,946 to Vassilev et al. In the Vassilev patent, the aluminum cladding includes a C-shaped cladding member that snaps onto a wooden frame member and is retained by a groove in both the wooden frame member and an opposing L-shaped member using a clamping action. In order to perform this snap on function and attach the aluminum cladding to the wooden frame member using a mechanical process, the aluminum cladding must be flexible enough to slide over the wooden frame and into the retaining grooves. In addition, the aluminum cladding member incorporates a stiffening rib that creates a gap between the exterior facing surface of the wooden frame member and interior surface of the aluminum cladding. While the rib is relatively short and assists in narrowing the cross-sectional profile of the window structure, nonetheless a gap is introduced, and the aluminum cladding only touches the wooden frame member where the ribs project from the main body of the aluminum cladding. Such gap creates an air pocket and is often used to allow condensation due to thermal differences that forms between the aluminum cladding and the wooden frame member to collect and then drip out through an opening in the bottom of the cladding to assist in keeping moisture away from the wooden frame member. As the wood frame provides the structural element and the aluminum only the decorative and weatherproofing element, a gap is also necessary to allow the wood room to expand and contract.

In addition, the aluminum cladding discussed in Vassilev is not a self-supporting structure. The cladding members are merely butted up against one another and may be caulked at the seams. The aluminum cladding, while protecting the exterior surface of wooden frame members from the elements is primarily decorative and provides no structural integrity. Instead, the joined together wooden frame members provide the structural element in this construction. Also, as readily seen in FIG. 2 of the Vassilev patent, the cladding projects well above the lowermost extent of the glass thereby reducing the sightline through the glass portion of the window.

Given the foregoing drawbacks of an all metal frame, an all wood frame, an aluminum clad frame, and all vinyl frame, there exists a need for a composite fenestration assembly that takes advantage of a combination of the insulating qualities of a non-ferrous material such as wood and the strength of a ferrous-based material such as steel while presenting both pleasing interior and exterior profiles and thin profiles with narrow sight lines to overcome the drawbacks of prior fenestration constructions.

BRIEF SUMMARY

In accordance with this disclosure, a composite fenestration assembly constructed of at least two different materials may be in the form of a glazing border constructed of a non-ferrous material and defining at least one glazing opening, the glazing border including a glazing support surface facing toward the glazing opening and an outwardly facing exposed surface when positioned within the rough opening while an overlay constructed of a rigid ferrous material provides the structural framework to support the glazing border and defines an interior facing surface slipped onto the glazing border to cover at least a portion of the outwardly facing exposed surface of the glazing border in an abutting relationship with the glazing opening forming a combined glazing border and inner overlay assembly.

In another implementation, an outer frame and outer overlay may be combined in a similar manner to the glazing border and inner overlay assembly and may be employed to provide a support structure between the rough framing of a structure and the glazing border and inner overlay assembly.

In yet another implementation, a first leg of at least one overlay projects in a different direction than a second leg of the same overlay with the first leg interposed between a glazing assembly and the glazing support surface of a glazing border.

In yet another implementation, the border may be constructed of a non-ferrous material such as wood and the overlay constructed of a ferrous material such as steel.

Another implementation may incorporate an overlay without hooks or catches on an interior surface.

Another implementation may include an overlay with an interior surface that directly abuts, with or without an intermediate adhesive layer, an exposed surface of a corresponding border without any air gaps therebetween.

In at least one implementation, the thermal coefficient of the border is lower than the thermal coefficient of the overlay with no thermal break therebetween.

Another implementation may incorporate a glazing stop of a third material.

In yet another implementation, the original sight lines of a glazing secured within the glazing border are not reduced by the overlay.

Methods for constructing and assembling dual material fenestrations are also disclosed herein.

BRIEF DESCRIPTION OF THE DRAWINGS

Features and advantages of the various exemplary embodiments disclosed herein will be better understood with respect to the following illustrative description and drawings, which are not intended to limit the scope of the disclosure, and in which like numbers refer to like parts throughout and reference numbers may be re-used to indicate correspondence between referenced elements, and in which:

FIG. 8B is a cross-sectional view of the French door of FIG. 8A taken through casement section lines 12-12 and 13-13.

DETAILED DESCRIPTION OF THE PREFERRED EMBODIMENTS

Figure 1B:
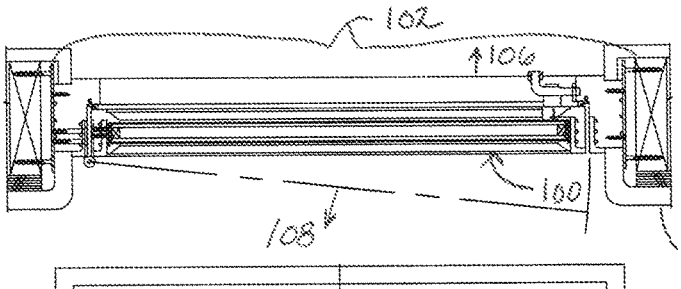
FIG. 1B is a cross-sectional view of the casement window of FIG. 1A taken through casement section lines 5-5 and 6-6.

Exemplary Composite Fenestration Assembly (Outward Swing Casement Window): Referring initially to FIGS. 1A-6, a first exemplary embodiment of a composite fenestration assembly, generally designated 100, may be provided for installation in a rough opening 102 of a structure 104 and dividing an interior 106 from an exterior 108 while allowing light to pass therethrough. Such structure 104 may be any structure wherein a fenestration unit may be installed. For example, the composite fenestrations assemblies are most commonly used in residential and commercial buildings in both the interior and exterior regions. However, vehicles, aircraft, and nautical craft may also employ portals and other openings that may accommodate a composite fenestration assembly as described herein.

As defined in this disclosure, although the term fenestration was originally used as an architectural term for the arrangement of windows, doors and other glazed areas in a wall, the term has evolved to become a standard industry term for windows, doors, skylights, and other glazed openings in a structure. A glazed opening is an opening that includes a glass panel, such as a door or window. The glazed opening may include a movable component. For example, an inswing or outswing window may include a movable glass panel surrounded by a sash. The opening may alternatively be fixed and non-openable; for example, a fixed light or picture window. In this disclosure, the term fenestration shall also apply to both the openings in the structure, whether framed or not, and the windows, doors, and skylights set within such openings. In this initial example, the composite fenestration assembly 100 will be described in terms of a rectangular outward swinging casement window installed in a building 104 (FIGS. 1B-1C) as just one example.

The Inner Support Structure Sub-Assembly: With continued reference to FIGS. 1A-6, the composite fenestration assembly 100 may be entirely made up of or include one or more sub-assemblies. In this exemplary embodiment, the composite fenestration assembly includes at least an inner glazing support structure sub-assembly, generally designated 110. The inner sub-assembly 110, also referred to as the protected sash in this example, generally comprises two primary components, a glazing border, generally designated 112, and also referred to as the sash or movable portion of the composite fenestration assembly 100, and an inner overlay, generally designated 114, providing the rigid structural framework for the glazing border 112 and constructed to protect the glazing border from the exterior elements while also providing a pleasing metal frame fenestration exterior appearance. It will be appreciated that this construction is the opposite of a dual material conventional window such as a wood frame window with aluminum cladding wherein the wooden frame provides the structural framework and the non-structural aluminum cladding is merely a decorative outer surface providing a weather resistant cover for the otherwise exposed exterior wood surface.

Figure 1C:
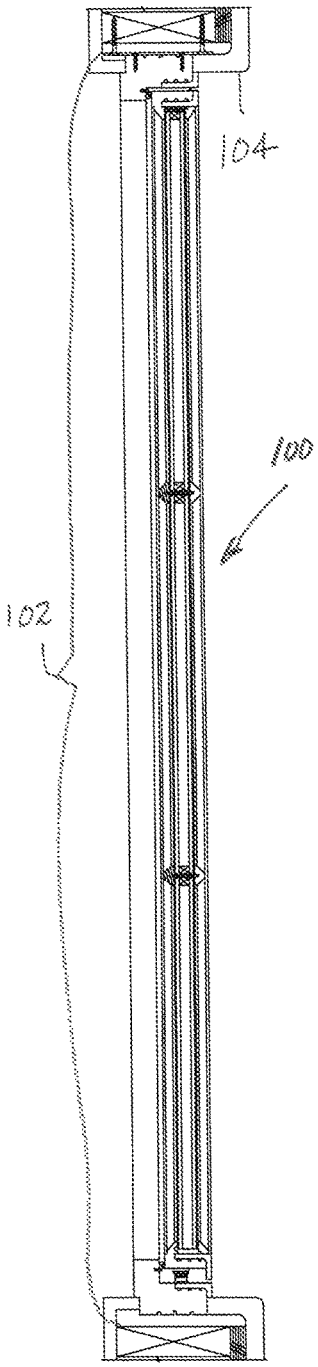
FIG. 1C is a cross-sectional view of the casement window of FIG. 1A taken through casement section lines 3-3 and 4-4.
Figure 1A:
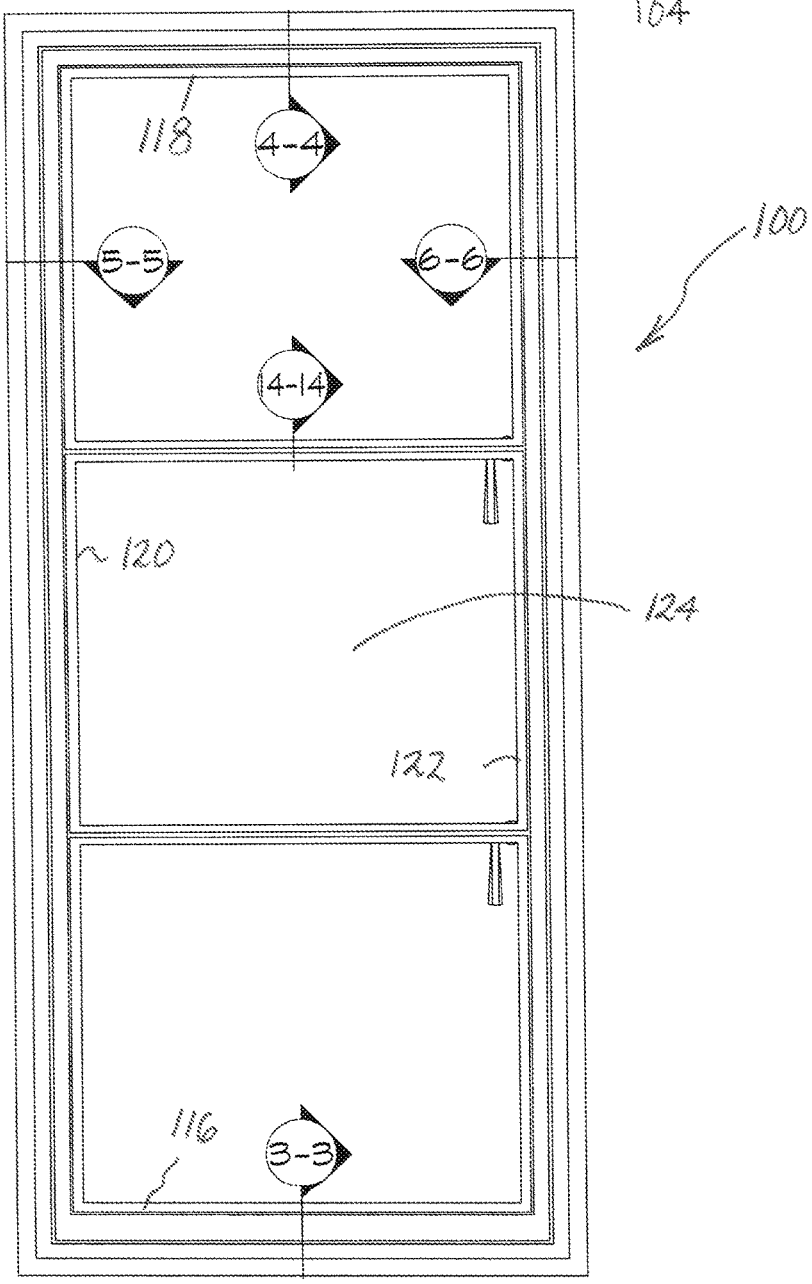
FIG. 1A is a front exterior elevation view of an exemplary composite fenestration assembly in the form of a casement window.
Figure 2:
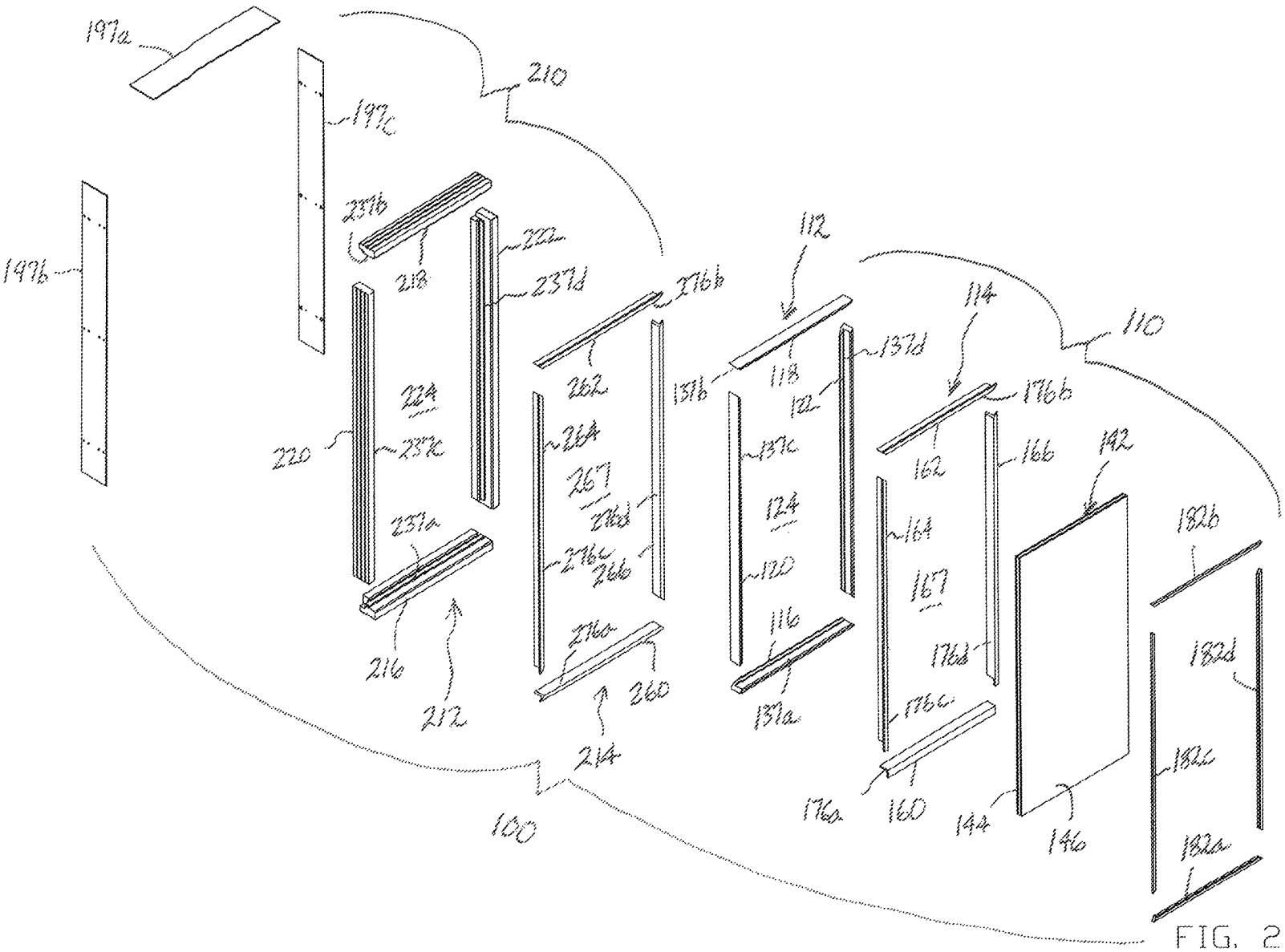
FIG. 2 is an exploded view of the casement window of FIGS. 1A-1C, in reduced scale.
Figure 3:
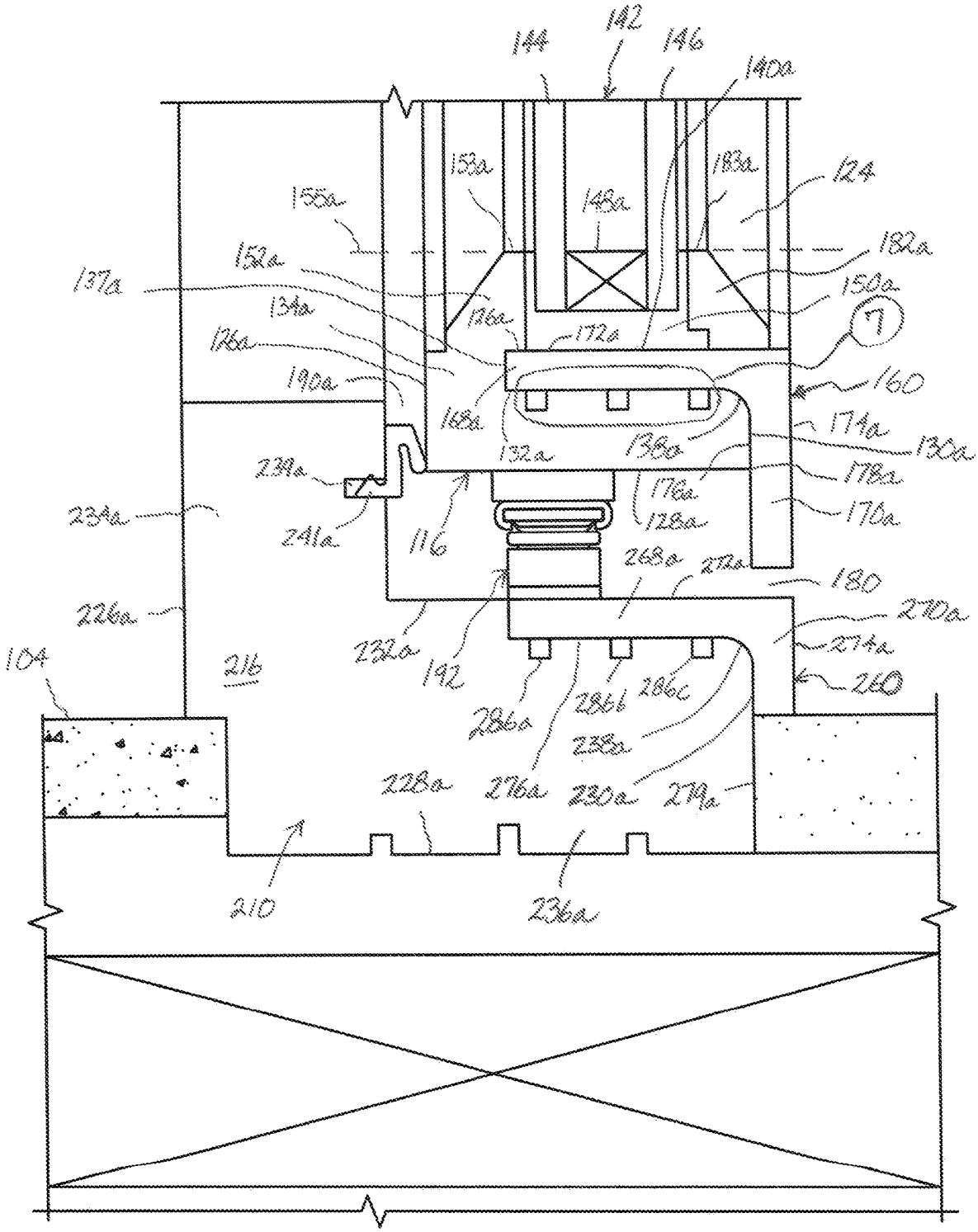
FIG. 3 is a cross-sectional view taken from section line 3-3 of FIG. 1 depicting the sill area detail in enlarged scale.

As shown in more detail in FIGS. 2-6, the glazing border 112 in this example includes a number of non-ferrous based material components or members including a laterally projecting bottom rail 116 (FIG. 3), an opposing laterally projecting top rail 118 (FIG. 4), and a pair of opposing left and right stiles 120 (FIG. 5), 122 (FIG. 6), respectively, spanning the gap between the bottom and top rails. In this exemplary embodiment, the border is preferably constructed of wood or a wood-based material, composite, or laminate, chosen for its superior thermal insulation characteristics, although vinyl, fiberglass, or other suitable non-ferrous based material may also be used. As shown in FIGS. 1A and 2, the sash components 116, 118, 120, and 122 are joined together using conventional window construction techniques and define a glazing opening 124 therebetween.

As best shown in FIGS. 3-6, the glazing border members 116, 118, 120, 122 include an interior facing surface 126*a-d*, an outward facing surface 128*a-d*, an exterior facing surface 130*a-d*, and a glazing opening facing surface 132*a-d*, respectively. The interior facing surfaces 126*a-d* present a decorative surface that is responsible for presenting the preferred interior view when the composite fenestration assembly 100 is mounted within the rough opening 102 (FIGS. 1B-1C). In this example, the decorative surface is merely the interior surface of the wooden border. It could also be a veneer added to the interior surface or decorative inlay. In this exemplary embodiment, the interior surface is generally planar and projecting parallel with a vertical plane passing through the rough opening in the building structure. However, the interior surface may incorporate other decorative profiles as well such as commonly used in window framing.

With continued reference to FIGS. 3-6, the outward facing surfaces 128*a-d* of the glazing border members 116, 118, 120, 122 face the corresponding inwardly facing surfaces 232*a-d* of the outer frame sub-assembly 210 (FIG. 2) discussed below and generally provide a set of one or more surfaces for mounting, positioning, or abutting the inner sub-assembly 110 (FIG. 2) to the outer sub-assembly 210 or may present a gap to be filled with a weatherproofing component. The exterior facing surfaces 130*a-d*, also referred to as the exposed surfaces since such surfaces would otherwise normally be exposed to the elements when the composite fenestration assembly is mounted within the rough opening without some sort of protective covering, present a generally planar surface paralleling the corresponding interior facing surfaces 126*a-d*. The glazing opening facing surfaces 132*a-d* face inwardly toward the glazing opening 124 (FIGS. 1A and 2) and are generally divided into two sections. The first section is the interior stop section 134*a-d* and the second adjacent section 136*a-d* forms a glazing support section and projects partially beneath the interior stop section and extends toward the exposed surfaces 130*a-d*. Curved shoulders 138*a-d* provide a transition surface from the corresponding glazing opening facing surfaces 132*a-d* and the exposed surfaces 130*a-d*. In this exemplary embodiment, the glazing opening facing surface 132*a-d* is recessed from the outer extent 140*a-d* of the glazing assembly, generally designated 142, within a recessed region 137*a-d* (FIGS. 2-6). The recessed regions may be completely filled with corresponding members of the overlay 114 as described below and as shown in FIGS. 3-6 or partially filled. In other words, the first legs 168*a-d* of the inner overlay may be interposed between the outer extent 140*a-d* of the glazing assembly and the corresponding glazing opening facing surfaces 132*a-d*, partially interposed, or not interposed at all. If interposed, such first legs provide a rigid support for the glazing assembly and likely reduce the impact of movement on the glazing assembly in the form of contraction or expansion by the non-ferrous border. Such construction extends to other embodiments discussed herein as well. The recessed regions 137*a-d* may be introduced into the wood glazing border members 116, 118, 120, 122 as a single or series of relief cuts, rabbets, rebates, notches, grooves, step cuts, or otherwise machined during the assembly process. Such relief cut is preferable to accommodate the thickness of the overlay 114 described below.

With continued reference to FIGS. 2-6, the glazing assembly 142 in this example is a dual pane window with an inner pane 144 and an outer pane 146 separated by a spacer 148*a-d* and bounded by a silicone molded seal 150*a-d*. The space between the panes may be vacuum, or filled with air, Argon, or other gas. The interior stop sections 134*a-d* includes an interior stop 152*a-d* integral with or secured against the respective interior stop section to provide an interior inhibitor against the glazing moving inwardly to the interior of the structure when mounted within the rough opening 102 (FIGS. 1B-1C) relative to the glazing border 112.

Referring still to FIGS. 2-6, the inner overlay 114 or protective sash overlay includes a number of ferrous-based material components or members including a laterally projecting bottom rail 160, an opposing laterally projecting top rail 162, and a pair of opposing left and right stiles 164, 166, respectively spanning the gap between the top and bottom rails. The inner overlay members 160, 162, 164, and 166 generally correspond to their respective glazing border counterparts 116, 118, 120, and 122, respectively. In this exemplary embodiment, the overlay is preferably constructed of ferrous-based material such as angle iron, chosen for its superior structural strength, although other suitable ferrous-based materials may be used. Angle iron may also be referred to as steel angle. The protective sash overlay components 160, 162, 164, and 166 are joined together by welding the adjacent components together at their respective corners to define a structurally integral framework for the glazing border with an opening 167 that generally aligns with glazing opening 124 when the inner overlay 214 and glazing border 212 are brought together. The overlay components may be mitered, straight cut, or abutted together with other suitable joints.

As shown in FIGS. 3-6, the inner overlay members 160, 162, 164, and 166 include a first leg 168*a-d* and a second leg 170*a-d* projecting at a right angle to the first leg. The first leg includes a glazing opening facing surface 172*a-d* while the second leg includes an exterior facing surface 174*a-d*. Opposing these surfaces 172*a-d* and 174*a-d* are interior overlay surfaces 176*a-d* that complement at least a portion of the respective glazing opening facing surfaces 132*a-d*, the transition shoulders 138*a-d*, and at least a portion of the exposed surfaces 130*a-d* of the respective border components 116, 118, 120, and 122 of the glazing border 112 such that each overlay member 160, 162, 164, and 166 may be placed in a close abutting relationship with its corresponding border component 116, 118, 120, and 122.

In this first exemplary embodiment, the first leg 168*a-d* of the inner overlay components 160, 162, 164, and 166 extends between the glazing assembly 142 and the glazing opening facing surfaces 132*a-d* of the glazing border 112. This provides a firm mounting surface for securing the glazing assembly 142. However, this is not meant to be limiting and the first leg may extend a shorter distance across the glazing opening facing surface 132*a-d* and/or without extending between the glazing assembly and the glazing opening facing surface. It will also be appreciated that the glazing opening surfaces 172*a-d* do not extend into the glazing opening 124 so as not to interfere with the sightlines, defined by a plane 155*a-d* passing through the innermost extents 153*a-d* and 183*a-d* of the corresponding inner stops 152*a-d* and outer stops 182*a-d*, respectively, through the glazing assembly 142. In this exemplary embodiment the first legs 168*a-d* are disposed between the silicone seal 150*a-d* and the glazing opening facing surfaces 132*a-d* within the recessed regions 137*a-d*.

With continued reference to FIGS. 3-6, the second legs 170*a-d* of the inner overlay 114 (FIG. 2) extend at a right angle from the corresponding first legs 168*a-d* and further extend away from the glazing assembly 142 to cover the entire collective exposed surfaces 130*a-d* of the glazing border 112 in each view as shown in FIGS. 3-6. In the sill view (FIG. 3), the second leg 170*a* extends past an outermost edge 178*a* of the glazing border and into the gap 180 between the inner sub-assembly 110 and the outer sub-assembly 210. In the head view (FIG. 4), in the jamb detail—hinge side view (FIG. 5), and jamb detail—off hinge side view (FIG. 6), the second legs 170*b-d* terminate at a position flush with their respective outer facing surface 178*b-d* of the glazing border 112. This overlay 114 construction is unlike the aluminum cladding solutions that include a metallic protective section projecting toward the glazing and result in covering up or obscuring a portion of the glazing thus reducing the overall sight lines and viewing area of the glazing.

The inner overlay 114 is typically constructed to match the corresponding inner perimeter region made up of the interior facing glazing opening surface 132*a-d* and exposed surface 130*a-d*, and the transition 138*a-d* therebetween to maintain the sight lines through the glazing panes 144, 146 as large as possible, typically preserving the original sight-lines even after the overlay is assembled to the glazing border, while still providing the structural framework for the glazing border 112.

In addition to the interior stop 152*a-d*, an exterior stop 182*a-d* may be employed to secure the glazing assembly 142 in place from the exterior. The exterior stop may be integral with the overlay or secured thereto. This exterior stop may be constructed of a ferrous-based material as with the overlay or, alternatively, aluminum, or other suitable weather resistant material and finished to match or stand out from the exterior surface 174*a-d* of the inner overlay 114.

With reference to FIGS. 2-6, the glazing border 112 may be slip fit into the inner overlay 114 resulting in the interior surfaces 176*a-d* of the first and second legs 168*a-d*, 170*a-d*, respectively, of the inner overlay directly abutting and covering at least a portion of and preferably all of the exposed surfaces 130*a-d* of the glazing border 112 and the transition shoulder 138*a-d* as well as at least a portion and preferably all of the glazing opening facing surface 132*a-d*. The resulting overlap between the inner overlay and glazing border is something resembling a handshake connection or joint. In other words, any portion of the glazing border 112 that may be exposed to the elements when the inner sub-assembly 110 is secured to the building structure 104 (FIGS. 1B-1C) through a connection to the outer sub-assembly 210 and within the rough opening 102 is preferably covered by the overlay 114. Alternatively, the rigid inner overlay 114 may be slip fit over the glazing border 112 without any need to flex the first and second legs 168*a-d* and 170*a-d*, respectively. Such precision fit is generally obtained using precision wood machining equipment and precision metal working equipment. In this exemplary embodiment, no air gaps exist between these inner overlay and glazing border surfaces. As the inner overlay 114 provides the structural integrity of the inner sub-assembly 110, the non-ferrous based material such as wood may be constructed with less thickness than a conventional wooden window if desired thereby reducing the amount of expansion and contraction and overall thickness of the inner sub-assembly 110 and thus the composite fenestration assembly 100.

To secure the inner overlay 114 to the glazing border 112, a layer of structural adhesive or sealant 184 (FIG. 7) suitable for bonding a ferrous based material to a non-ferrous based material may be employed to bond the two components together. The bonding components may be suitably prepared prior to applying the adhesive. In some instances, a series of grooves 186*a-c* as, for example, shown in FIG. 3, may be introduced into the glazing opening facing surface 132*a-d* to provide an overflow reservoir for the adhesive for a better bonding event. Alternatively, grooves may be introduced into the interior surface of the inner overlay or in both the ferrous and non-ferrous based materials. Such structural adhesive preferably alleviates the need for mechanical fasteners but such fasteners such as screws, bolts, and nails may be used as well or as an alternative to the adhesive. The structural adhesive and rigidity of the inner overlay 114 also ensures minimal wood movement. Reducing the wood movement aids in also reducing the likelihood of cracking the glazing. With the protective inner overlay 114 affixed to the glazing border 112, the structural integrity of the inner overlay allows for the inner sub-assembly 110 to be secured by fastening just the inner overlay to the outer sub-assembly 210. In other words, no mounting or fastening hardware need penetrate the glazing border in order to secure the inner sub-assembly 110 to the outer sub-assembly, although this is not meant to be limiting and hardware may project into or through the glazing border 112 as well as, for example, shown by hinge, generally designated 194, in FIG. 5.

It will be appreciated that the inner overlay 114 in this exemplary embodiment does not incorporate any opposing or mirroring interior surfaces in that no portion of the interior surfaces 176*a-d* for a particular inner overlay member 160, 162, 164, 166 of the inner overlay 114 directly face across from one another as shown in FIGS. 3-6. This is generally achieved by employing a second leg 170*a-d* that projects from the first leg 168*a-d* at an angle ranging from ninety degrees up through two hundred and seventy degrees, and preferably at a right angle up through an obtuse angle. This overlay construction is therefore unlike the clamping style claddings in other windows in which two or more surfaces face directly across from one another to form a C-shape or channel to enable clamping on the wooden frame component. Moreover, the interior surfaces 176*a-d* of the inner overlay 114 are smooth with a generally planar interior surfaces of the first legs 168*a-d* and a generally planar interior surfaces of the second legs 170*a-d* with curved transitions 138*a-d* therebetween. No catches or hooks are needed on the interior surfaces 176*a-d* or anywhere on the overlay members 160, 162, 164, and 164 to secure the overlay 114 to the glazing border 112 as a structural adhesive is all that is necessary. No other mechanical fasteners are needed but may be used if desired.

The Outer Support Structure Sub-Assembly (Outer Frame): Referring now to FIG. 2, in addition to the inner support structure sub-assembly 110, an outer support structure sub-assembly or outer sub-assembly, generally designated 210, may be provided. The construction of the outer support structure sub-assembly is similar in many instances to the glazing support structure sub-assembly 110. However, the two sub-assemblies 110, 210 serve different functions. The inner support structure sub-assembly 110 primarily serves to define one or more glazing openings 124 and support one or more glazings or windowpanes 144, 146 within and then be connected in some manner, either fixed to or moveable relative to the outer support structure sub-assembly 210. The outer support structure sub-assembly 210, on the other hand, is constructed to serve as the connection between the building structure 104 and the inner support structure sub-assembly 110. In this disclosure, the outer support structure sub-assembly is also referred to as the frame that is connected to the rough framing of the rough opening. The inner support structure sub-assembly 110 is often referred to as the sash, transom, awning, casement, portrait, or fixed panel, depending on the type of fenestration.

Referring still to FIG. 2, The outer sub-assembly 210 comprises two primary components, an outer border 212 or frame and an outer overlay 214 providing the structural framework for the outer border. It will be appreciated that this is the opposite of a dual material conventional window such as a wood frame window with aluminum cladding wherein the wooden frame provides the structural framework and the non-structural aluminum cladding is merely a decorative outer surface providing a weather resistant cover for the otherwise exposed exterior wood surface.

As shown in FIG. 2, the outer border 212, also referred to as the frame in this example, includes a number of non-ferrous based material components or members including a laterally projecting sill 216, an opposing laterally projecting head 218, and a pair of opposing left and right jambs 220, 222 respectively spanning the gap between the top head and the bottom sill. In this exemplary embodiment, the border is preferably constructed of wood or a wood-based material, chosen for its superior thermal insulation characteristics. The frame components 216, 218, 220, and 222 may be joined together using conventional window construction techniques and define an inner sub-assembly opening 224 therebetween.

As shown in FIGS. 3-6, each frame member 216, 218, 220, and 222 includes a set of interior facing surfaces 226*a-d*, outward facing surfaces 228*a-d*, exterior facing surfaces 230*a-d*, and also inner sub-assembly opening facing surfaces 232*a-d* that coincide with the glazing opening facing surfaces 132*a-d* of the glazing border. Like its counterpart in the glazing border 112, the interior facing surface 226*a-d* is a decorative surface that is responsible for presenting the preferred interior view when the outer sub-assembly 210 is mounted within the rough opening 102. In this example, the decorative surface is merely the interior surface of the wooden frame. It could also be a veneer added to the interior surface or decorative inlay. In this exemplary embodiment, the interior surface 226*a-d* is generally planar and projecting parallel with a vertical plane passing through the rough opening 102 (FIGS. 1B-1C) in the building structure 104. However, the interior surface may incorporate other decorative profiles as well such as commonly used in window framing.

With continued reference to FIGS. 3-6, the outward facing surfaces 228*a-d* face the rough framing surrounding the rough opening 102 (FIGS. 1B-1C) of the structure 104 and generally provides a surface for mounting the frame 212 to the rough framing using conventional window mounting techniques, such as, for example, nail fins, clips, or brackets. The exterior facing surfaces 230*a-d* of each frame member 216, 218, 220, and 222, respectively, also referred to as the exposed frame surface since such surface would otherwise be exposed to the elements when the outer sub-assembly 210 is mounted within the rough opening, form a generally planar surface paralleling the respective interior surfaces 226*a-d*. The inner sub-assembly opening facing surfaces 232*a-d* face inwardly toward the inner sub-assembly opening 224 and are generally divided into two sections. The first section is the interior block section 234*a-d* and the second adjacent mounting hardware section 236*a-d* projects outwardly from the interior block section and extends toward the exposed surface 230*a-d*. A set of curved shoulders 238*a-d* provides a set of transition surfaces between the inner sub-assembly opening facing surfaces 232*a-d* and the exposed surfaces 230*a-d*. In this exemplary embodiment, the inner sub-assembly opening facing surface 232*a-d* within the mounting section 236*a-d* includes a recessed region 237*a-d*. The recessed region may be introduced in a manner using the same or similar process for the glazing border 112 above. Such recessed region preferably accommodates the thickness of the outer overlay 214 described below. The interior block sections 234*a-d* include a slot 239*a-d* for receiving a weatherproofing seal or strip 241*a-d* that extends between the inner and outer sub-assemblies 110 and 210.

Referring now to FIGS. 2-6, the outer overlay 214 or frame protector includes a number of ferrous-based material components or members including a laterally projecting sill 260, an opposing laterally projecting head 262, and a pair of opposing left and right jambs 264, 266, respectively spanning the gap between the sill and head. The outer overlay members 260, 262, 264, and 266 generally correspond to their respective outer frame counterparts 216, 218, 220, and 222, respectively. In this exemplary embodiment, the outer overlay 214 is also preferably constructed of ferrous-based material such as angle iron, chosen for its superior structural strength. The outer overlay components 260, 262, 264, and 266 are joined together by welding the adjacent components together at their respective corners to define a structurally integral framework for the frame with an outer overlay opening 267 that generally aligns with frame opening 224 when the outer overlay 214 and outer frame 212 are brought together. The outer overlay components 260, 262, 264, and 266 may be mitered, straight cut, or abutted together with other suitable joints.

As shown in FIGS. 2-6, each outer overlay member 260, 262, 264, and 266 includes first leg 268*a-d* and a second leg 270*a-d* projecting at a right angle to the first leg. The first leg includes an inner sub-assembly facing surface 272*a-d* while the second leg includes an exterior facing surface 274*a-d*. Opposing these surfaces 272*a-d* and 274*a-d* are interior outer overlay surfaces 276*a-d* that complement 1908 at least a portion of the inner sub-assembly opening facing surface 232*a-d*, the transition shoulder 238*a-d*, and at least a portion of the exposed surface 230*a-d* of the respective outer frame members 216, 218, 220, and 222 of the outer frame 212 such that each outer overlay member 260, 262.264, and 266 may be placed in a close abutting relationship with its corresponding outer frame component 216, 218, 220, and 222.

In this exemplary embodiment, the first leg 268*a-d* of the outer overlay 214 extends parallel to the outward facing surface 128*a-d* of the glazing border 112 stopping short of the first block section 234*a-d*. The inner sub-assembly facing surfaces 272*a-d* of the first legs 268*a-d* of the outer overlay 214 are also parallel to their corresponding glazing opening facing surfaces 172*a-d* of the first legs 168*a-d* of the inner overlay 114 in this example, although this is not meant to be limiting. In this exemplary embodiment, the first legs 268*a-d* of the outer overlay extend toward the first block section to match the depth of the innermost projection of the first leg 168*a-d* of the inner overlay as shown FIGS. 3-6. However, this is not meant to be limiting and the first leg may extend more or less than this distance. The second leg 270*a-d* of the outer overlay extends at a right angle from the first leg and covers the entire exposed surface 230*a-d* of the outer frame 212 in each view as shown in FIGS. 3-6 except for a return region 279*a-d* where another building component such as molding, stucco, or other covering will overlap and protect that portion of the outer frame from the elements.

The outer overlay 214 is typically constructed to match the corresponding inner perimeter region of the outer frame 212 made up of at least portions of the interior facing inner sub-assembly opening surface 232*a-d* and exposed surface 230*a-d*, and the transition 238*a-d* while also not interfering with the sight lines in the inner sub-assembly 110. The outermost surfaces 174*a-d* of the inner overlay 114 and the outermost surfaces 274*a-d* of the outer overlay are coplanar in this exemplary embodiment, although this is not meant to be limiting and the outermost surfaces of the overlays may be offset to one another.

With reference to FIGS. 2-6, the outer frame 212 may be slip fit into the outer overlay 214 resulting in the interior surfaces 276*a-d* of the first and second legs 268*a-d* and 270*a-d*, respectively, of the outer overlay directly abutting and covering at least a portion of and preferably all of the exposed surfaces 230*a-d* of the outer frame 212 and the transition shoulders 238*a-d* except for the return regions 279*a-d*, and at least a portion of the inner sub-assembly opening facing surface 232*a-d* (also referred to as the inner sub-assembly surface). In other words, any portion of the outer frame 212 that may be exposed to the elements when the outer sub-assembly 210 is secured to the building structure 104 (FIGS. 1B-1C) within the rough opening is preferably covered by the outer overlay 214. Alternatively, the outer overlay 214 may be slip fit over the outer frame 212 without any need to flex the first and second legs 268*a-d* and 270*a-d*, respectively. In this exemplary embodiment, no air gaps exist between these outer overlay and outer frame surfaces. As the outer overlay 214 provides the structural integrity of the outer sub-assembly 210, the non-ferrous based material such as wood may be constructed with less thickness than a conventional wooden window if desired thereby reducing the amount of expansion and contraction and overall thickness of the outer sub-assembly 210 and thus the composite fenestration assembly 100.

Figure 7:
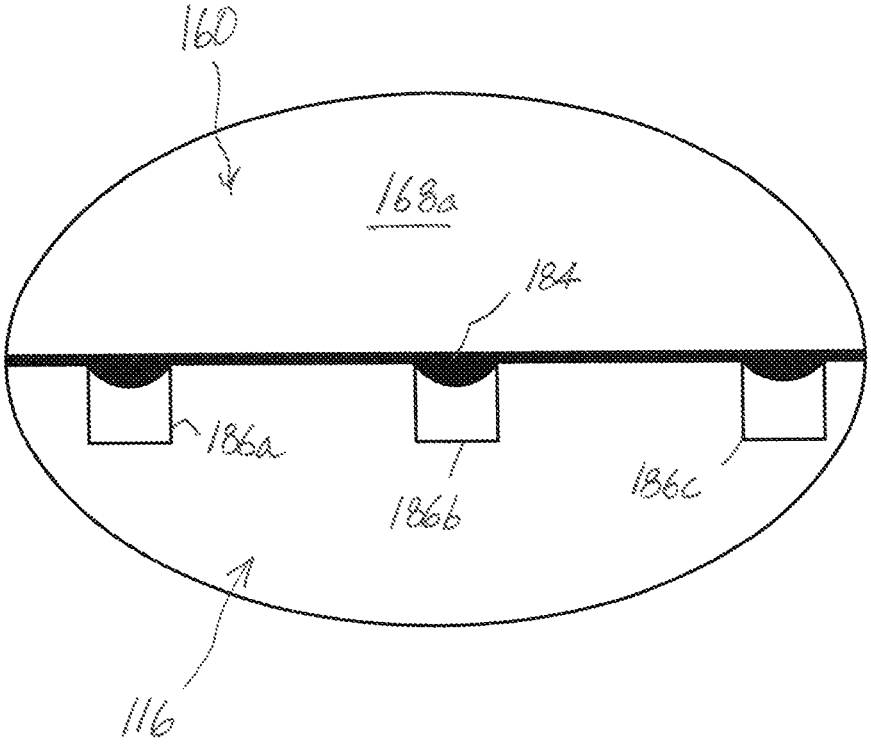
FIG. 7 is a close up view taken from circle 7 of FIG. 3 in enlarged scale depicting a layer of adhesive between the materials of the composite fenestration assembly.

To secure the outer overlay 214 to the outer frame 212, a layer of structural adhesive similar to the adhesive 184 in FIG. 7 may be employed to bond the two components together. The bonding components may be suitably prepared prior to applying the adhesive. In some instances, a series of grooves 286*a-c* as for example shown in FIG. 3, may be introduced into the inner sub-assembly facing surface 232*a-d* (also referred to as the inner sub-assembly surface) to provide an overflow reservoir for the adhesive for a better bonding event. Alternatively, grooves may be introduced into the interior surface of the outer overlay 214 or in both the ferrous and non-ferrous based materials. As with the inner overlay 114 and glazing border 112, such structural adhesive preferably alleviates the need for mechanical fasteners but such fasteners such as screws, bolts, and nails may be used as well or as an alternative to the adhesive. The structural adhesive and rigidity of the outer overlay 214 also ensures minimal wood movement. With the protective overlay 214 affixed to the outer frame 212, the structural integrity of the overlay allows for the outer sub-assembly 210 to be secured by fastening just the overlay 214 to the structure 104 (FIGS. 1B-1C). In other words, no mounting or fastening hardware need penetrate the outer frame in order to secure the outer sub-assembly 210 to the outer sub-assembly, although this is not meant to be limiting and hardware may project into or through the outer frame 214 as well as shown, for example, by nail fin 197*a* in FIG. 4.

As with the inner overlay 114 above, it will be appreciated that the outer overlay 214 in this exemplary embodiment does not incorporate any opposing surfaces and is therefore unlike the clamping style claddings in other windows. The interior surfaces 276*a-d* of the outer overlay 214 are smooth with a generally planar interior surface of the first legs 268*a-d* and a generally planar interior surface of the second legs 270*a-d* with a curved transition 238*a-d* therebetween. No catches or hooks are needed on the interior surface 276*a-d* or anywhere on the outer overlay members 260, 262, 264, 266 to secure the outer overlay 214 to the outer frame 212 as a structural adhesive is all that is necessary. No other mechanical fasteners are needed but may be used if desired.

In addition to the inner and outer sub-assemblies 110, 210, respectively, several other fenestration related components may be incorporated into a final installation within the rough opening 102 (FIGS. 1B-1C). These include weatherproofing components, installation and mounting hardware, and pane dividing features such as muntins.

Figure 4:
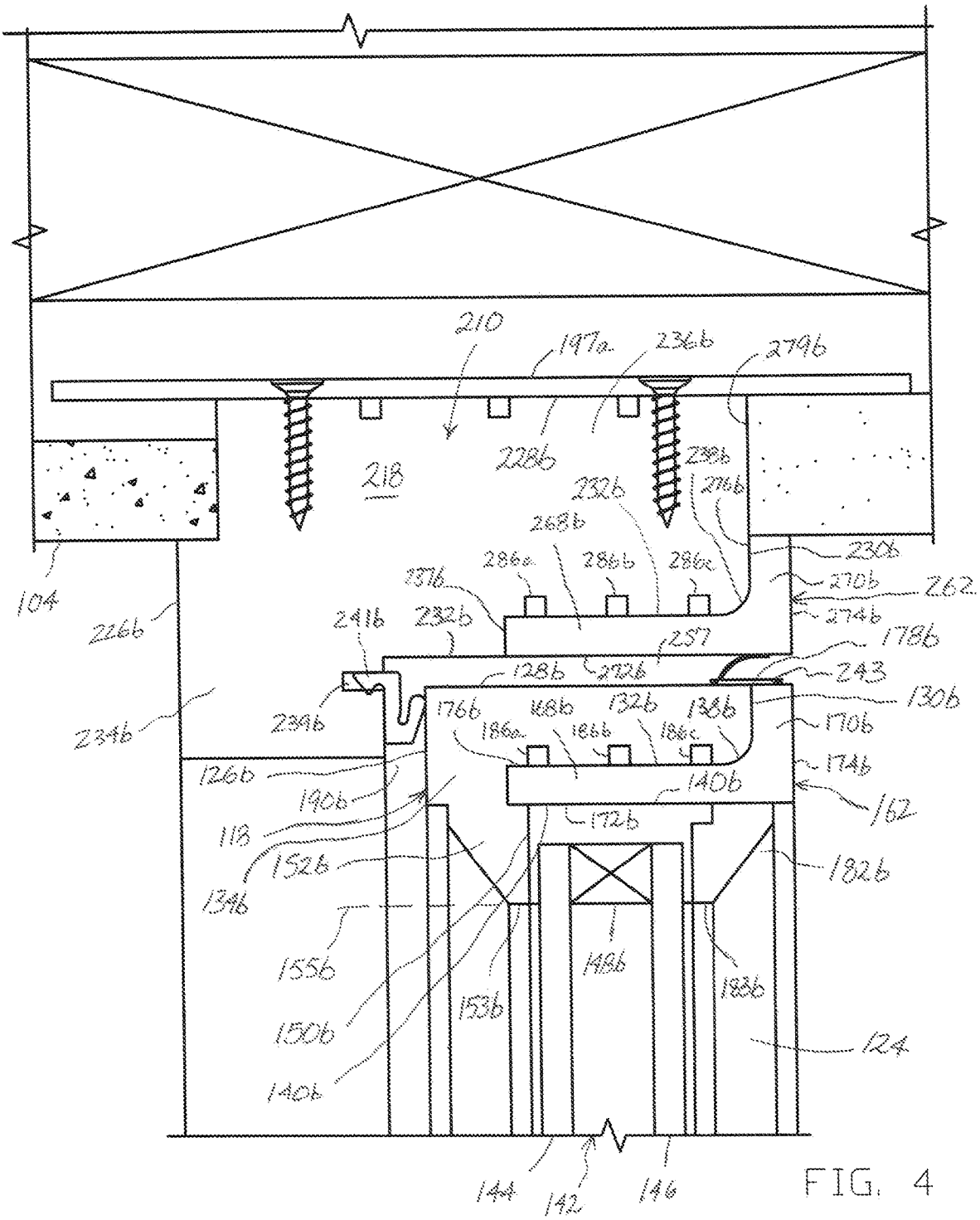
FIG. 4 is a cross-sectional view taken from section line 4-4 of FIG. 1 depicting the head area detail in enlarged scale.

Referring now to FIGS. 3-6, several weatherproofing components may be incorporated between the inner sub-assembly 110 and the outer sub-assembly 210. For example, in FIG. 3, a sill side weatherstrip 241*a* includes a first section engaged in slot 239*a* and a second section filling up a gap 190*a* between the interior surface 126*a* of the glazing border 112 and the interior block section 234*a* of the outer frame 214. Similarly, in FIG. 4, a head side weatherstrip 241*b* includes a first section engaged in slot 239*b* and a second section filling up a gap 190*b* between the interior surface 126*b* of the glazing border 112 and the interior block section 234*b* of the outer frame 214. Also, in FIG. 4 is another weatherstripping component 243 disposed in a gap 257 between the outward facing surface 128*b* of the inner sub-assembly 110 and the inner sub-assembly facing surface 272*b* of the first leg 268*b* of the head 216 of the outer sub-assembly 210.

Figure 5:
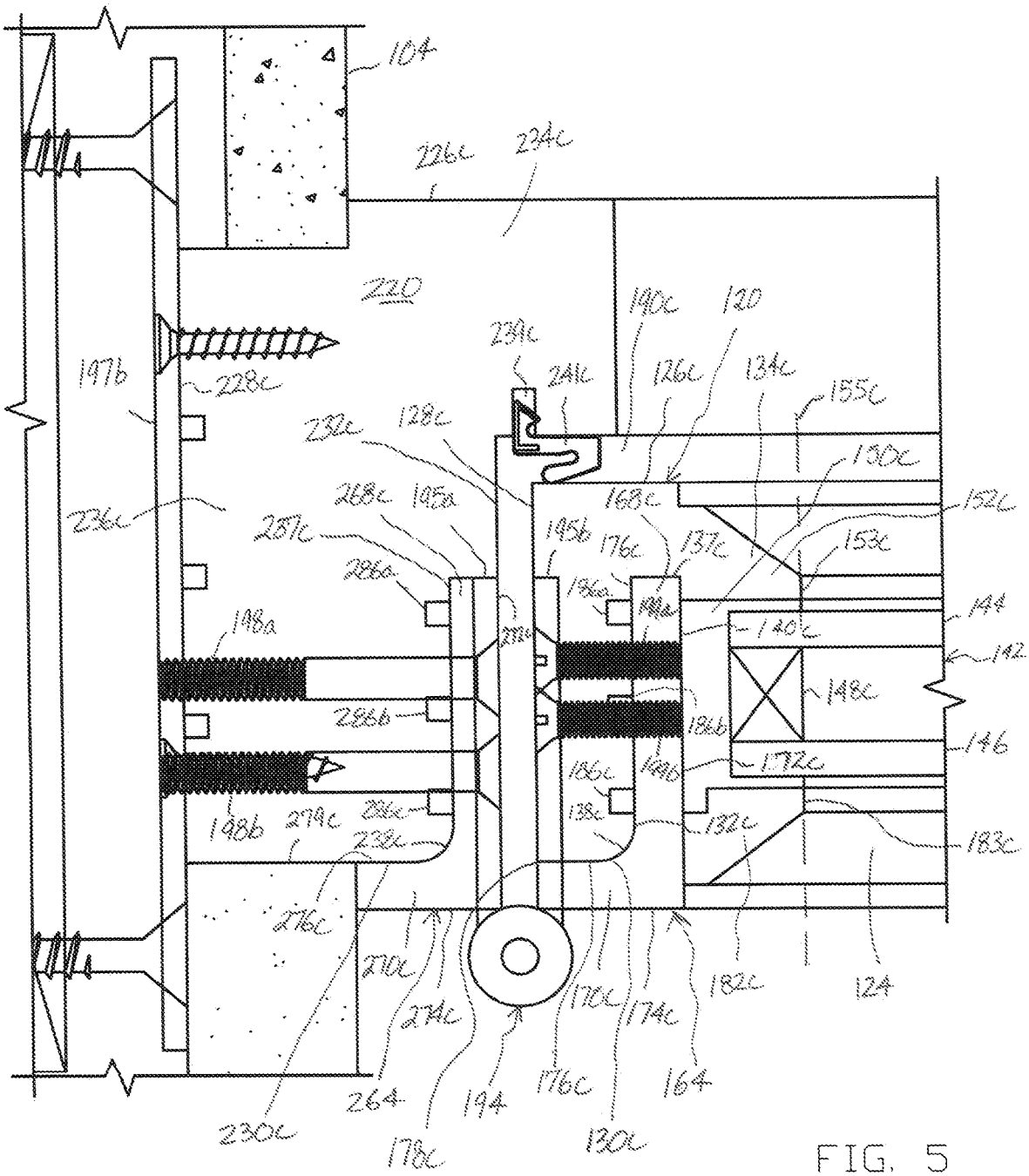
FIG. 5 is a cross-sectional view taken from section line 5-5 of FIG. 1 depicting the left side jamb detail in enlarged scale.
Figure 6:
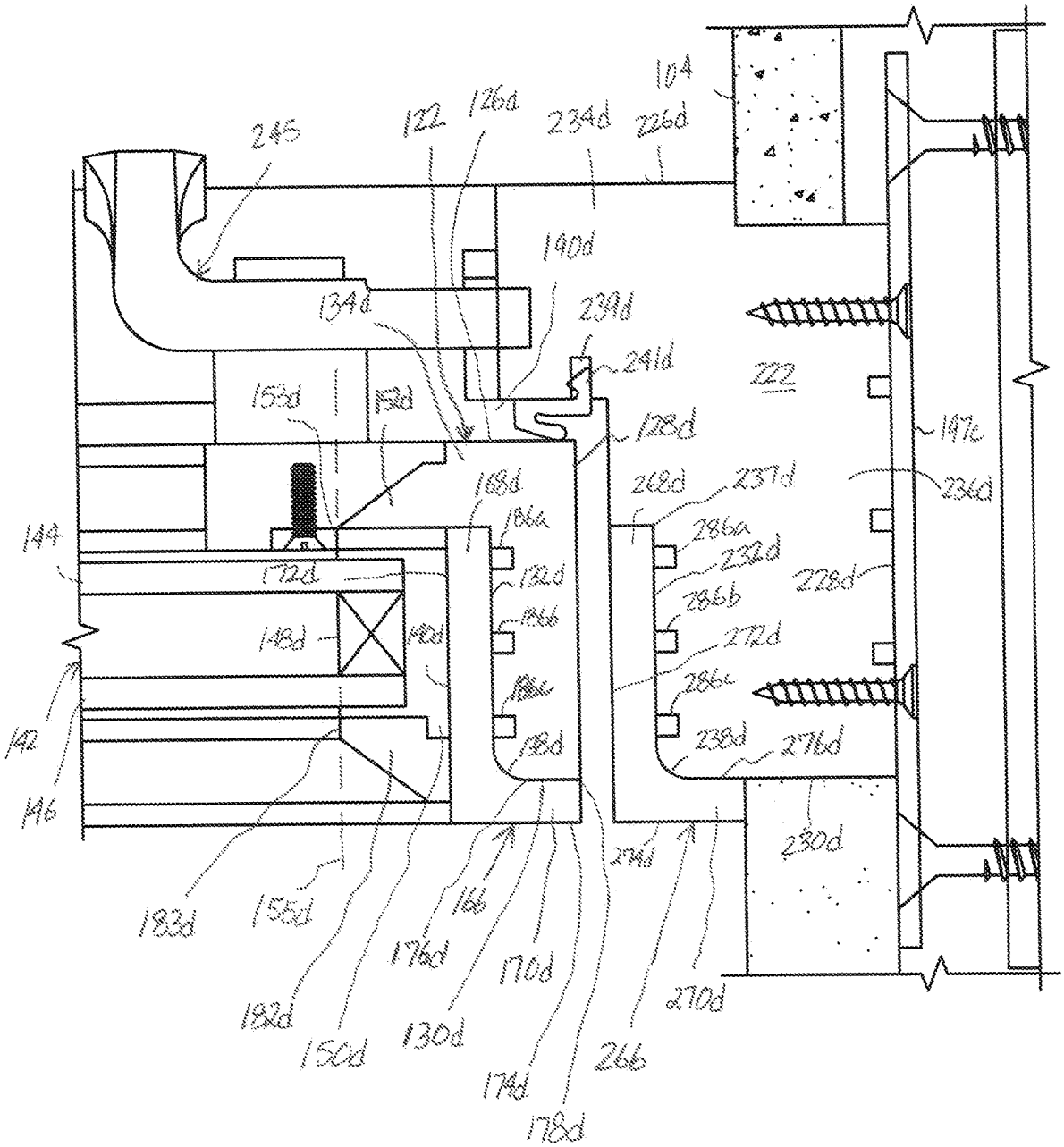
FIG. 6 is a cross-sectional view taken from section line 6-6 of FIG. 1 depicting the right side jamb detail in enlarged scale.

Also, in FIG. 5, a left side jamb weatherstrip 241*c* includes a first section engaged in slot 239*c* and a second section filling up a gap 190*c* between the interior surface 126*c* of the glazing border 112 and the interior block section 234*c* of the outer frame 214. In FIG. 6, a right side jamb weatherstrip 241*d* includes a first section engaged in slot 239*d* and a second section filling up a gap 190*d* between the interior surface 126*d* of the glazing border 112 and the interior block section 234*d* of the outer frame 214. Such weatherstripping inhibits the passage of air between the interior 106 and exterior 108 of the structure 104 when the composition fenestration assembly 100 is secured within the rough opening 102 and in a closed configuration (FIGS. 1B-1C). Additional weatherproofing components such as caulking, insulating foam, mohair strips, weatherproof papers, decorative molding, flashing, and the building finish may also contribute to weatherproofing the composite fenestration assembly 100 and surrounding area and assist in improving the insulation characteristics of the structure in the which the composite fenestration assembly is mounted. The location and securement of such weatherproofing components is well known and within one of ordinary skill in the art.

In addition to the weatherproofing components, various installation hardware may be employed such as locks and latches, operators, cranks, handles, hinges, bolts, rollers, hangers, strike plates, sweeps, nail fins, clips, and brackets, balances, door closer, to name a few. Such hardware may generally be grouped into hardware either fixedly or movably connecting the inner sub-assembly 110 to the outer sub-assembly 210 and hardware connecting the outer sub-assembly 210 to the framing defining the rough opening 102. For example, in the sill view of FIG. 3, a casement window friction stay, generally designated 192, defines one connection between the inner sub-assembly 110 and the outer sub-assembly 210. While the upper connection between the friction stay 192 and the inner sub-assembly is conventional, it will be noted that the first leg 268*a* of the outer overlay 214 may extend between the bottom of the friction stay and the sill 216. In such case, the first leg of the outer overlay may be machined to accommodate fasteners such as screws, bolts, or nails to secure the bottom of the stay to the sill component 218. Where the first leg is not interposed between the stay and the sill, connection may be made using conventional techniques. The sill 216 may be secured to the framing defining the rough opening 102 (FIGS. 1B-1C) as would be understood by one of ordinary skill in the art.

Turning now to FIG. 4, there is no hardware shown connecting the inner sub-assembly 110 to the outer sub-assembly 210 but a nail fin 197*a* is secured to the outward facing surface 228*b* of the head 218 of the outer sub-assembly 210. Such nail fin may be nailed to the framing surrounding the rough opening 102 as would be understood by one of ordinary skill in the art.

Turning now to FIG. 5, a hinge, generally designated 194, with a first leaf 195*a* connected to the left side jamb 220 of the outer sub-assembly 210 and a second leaf 195*b* connected to the outer facing surface 128*c* of the left stile 120. As shown in FIG. 4, the hinge leaves 195*a-b* are connected to their respective fenestration components 220, 120 using fasteners such as screws 198*a-b* or bolts 199*a-b*. Where a first leg 168*a-d* or 268*a-d* of either overlay 114, 214 is disposed within the connection path, the first leg may be modified to accommodate the passthrough of such fasteners such as by drilling a hole. In addition to the hinge 194, a nail fin 197*b* with an L-shaped construction similar to the nail fin 197*a* (FIG. 4) may be used to secure the left side jamb 220 to the framing defining the rough opening 102 as would be understood by one of ordinary skill in the art. It will be appreciated that wherever fasteners are used to the hardware to the sub-assemblies 110, 210 or to the structure 104, washers or an opposing backing plate constructed of a stronger material than the non-ferrous based material to receive the distal end of the fasteners may be employed to strengthen the connection.

In FIG. 6, the off-hinge side of the composite fenestration assembly 100, another nail fin 197*c* may be used to secure the right side jamb 222 to the framing defining the rough opening 102 as well. In addition, a crank handle or latch 245 (or both) may be provided to facilitate opening and closing the sash or inner sub-assembly 110 as would be understood by one of ordinary skill in the art.

While the foregoing embodiment of a composite fenestration assembly 100 has been described as an outward swing casement window, it will be appreciated that other embodiments may be constructed in accordance with this disclosure as, for example, a left handed outswing French door discussed below, among many others.

Exemplary Embodiment of a Composite Fenestration Assembly (Left Handed Outswing French Door): Referring initially to FIGS. 8A-13, a composite fenestration assembly, generally designated 300, is provided for installation in a rough opening 302 of a structure 304 and dividing an interior 306 from an exterior 308 while allowing light to pass therethrough. In this exemplary embodiment, as with the composite fenestration assembly 100 described above, such structure may be any structure wherein a fenestration unit may be installed, most commonly residential and commercial buildings, although vehicles, aircraft, and nautical craft may employ portals and other openings that would accommodate a composite fenestration assembly as described herein. In this example, the composite fenestration assembly will be described in terms of a rectangular left hand outswing French door installed in a building as another example. It will be appreciated that the door construction shares many similarities with the window construction described above with one of the main exceptions being that a window has a sill while a door has a threshold that requires a different construction as traffic will be crossing over the threshold as explained below.

The Inner Support Structure Sub-Assembly: With continued reference to FIGS. 8A-13, the composite fenestration assembly 300 may be entirely made up of or include one or more sub-assemblies. In this exemplary embodiment, the composite fenestration assembly includes at least an inner glazing support structure sub-assembly, generally designated 310, and in this example, generally forms the door or movable component of the composite fenestration assembly 300. The inner sub-assembly or door 310 comprises two primary components, a glazing border, generally designated 312, and an inner overlay, generally designated 314, providing the structural framework for the glazing border. It will be appreciated that, like the exemplary window described above, this is the opposite of a dual material conventional window such as a wood frame window with aluminum cladding wherein the wooden frame provides the structural framework and the non-structural aluminum cladding is merely a decorative outer surface providing a weather resistant cover for the otherwise exposed exterior wood surface.

Figure 9:
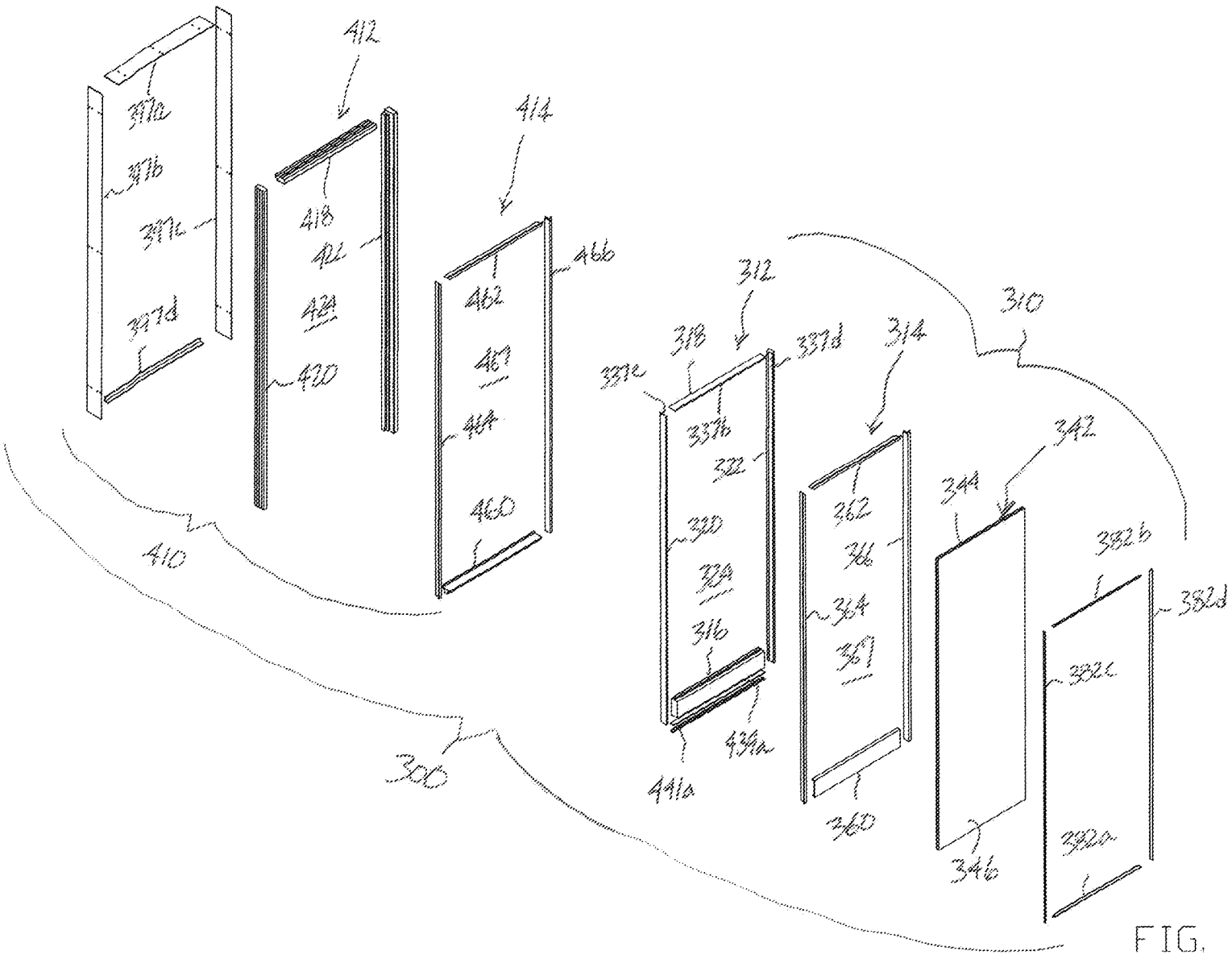
FIG. 9 is an exploded view of the French door of FIGS. 8A-8C, in reduced scale.

As shown in FIG. 9, the glazing border 312 includes a number of non-ferrous based material components or members including a laterally projecting bottom rail 316, an opposing laterally projecting top rail 318, and a pair of opposing left and right stiles 320, 322, respectively, spanning the gap between the top and bottom rails. In this exemplary embodiment, the border is preferably constructed of wood or a wood-based material, chosen for its superior thermal insulation characteristics. The door components 316, 318, 320, and 322 are joined together using conventional window construction techniques and define a glazing opening 324 therebetween. In this exemplary embodiment, the bottom rail may further include a door sweep track 439*a* for receipt of a door sweep 441*a* to assist in weatherproofing the bottom section of the door.

Figures 8A, 8C:
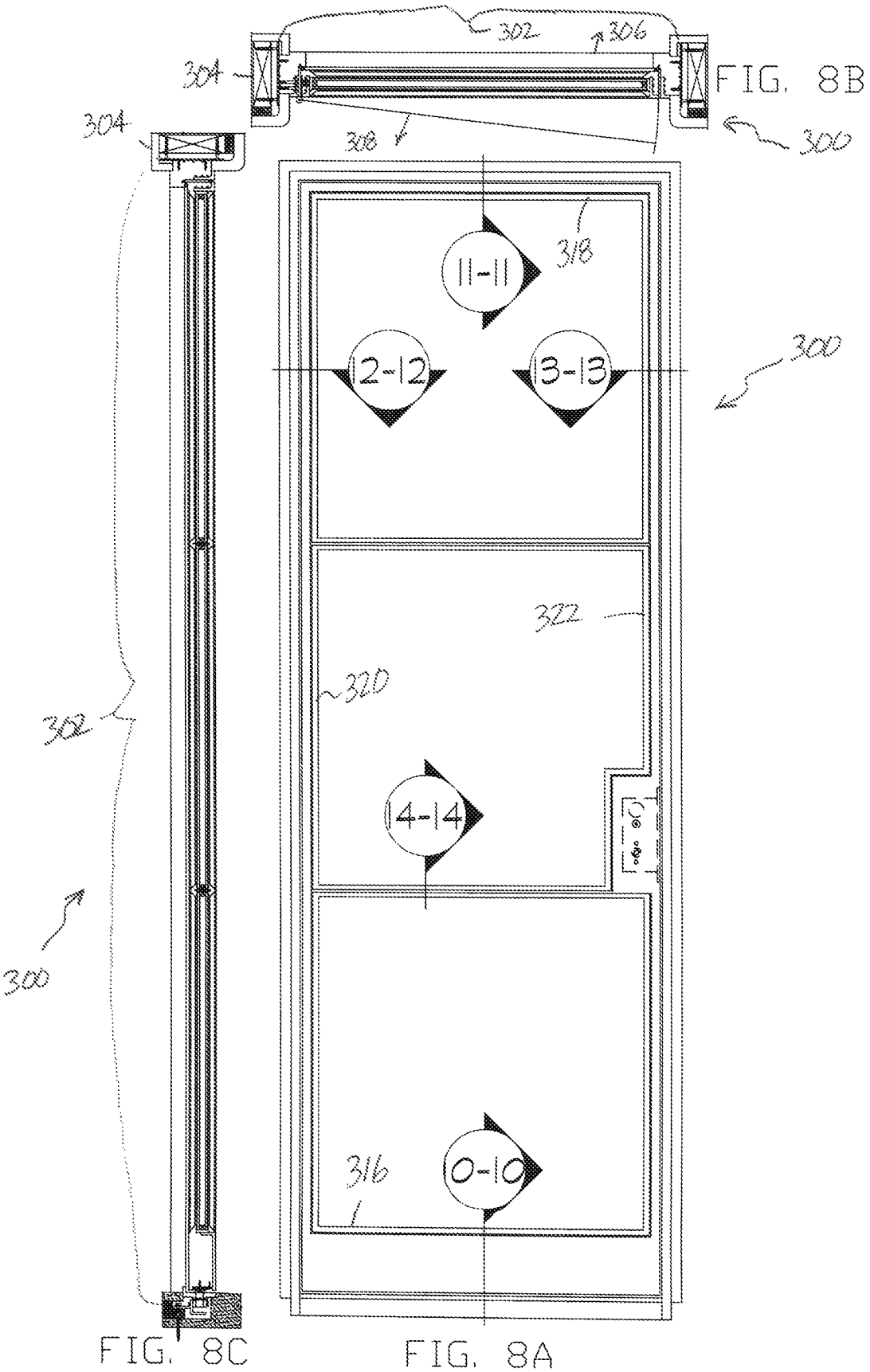
FIG. 8A is a front elevation view of another exemplary composite fenestration assembly in the form of a left hand outswing French door.
FIG. 8C is a cross-sectional view of the French door of FIG. 8A taken through casement section lines 11-11 and 10-10.

As shown in FIGS. 10-13, each border member 316, 318, 320, 322 includes a corresponding interior facing surface 326*a-d*, an outward facing surface 328*a-d*, an exterior facing surface 330*a-d*, and a glazing opening facing surface 332*a-d*. The interior facing surfaces 326*a-d* present a decorative surface that is responsible for presenting the preferred interior view when the composite fenestration assembly is mounted within the rough opening 302 (FIGS. 8B-8C). In this example, the decorative surface is merely the interior surface of the wooden border. It could also be a veneer added to the interior surface or decorative inlay. In this exemplary embodiment, the interior surface is generally planar and projecting parallel with a vertical plane passing through the rough opening in the building structure. However, the interior surface may incorporate other decorative profiles as well such as commonly used in door framing.

With continued reference to FIGS. 10-13, the outward facing surface 328*a-d* faces the inwardly facing surface 432*a-d* of the outer frame sub-assembly 410 discussed below and generally provides a surface for mounting, positioning, or abutting the inner sub-assembly 310 to the outer sub-assembly 410 or may present a gap to be filled with a weatherproofing component. The exterior facing surface 330*a-d* of each member 316, 318, 320, 322, also referred to as the exposed surface since such surface would otherwise be exposed to the elements when the composite fenestration assembly is mounted within the rough opening without some sort of protective covering, is a generally planar surface paralleling the interior surface. The glazing opening facing surface 332*a-d* faces inwardly toward the glazing opening

324 (FIG. 9) and is generally divided into two sections. The first section is the interior stop section 334*a-d* and the second adjacent section 336*a-d* extends from the interior stop section toward the exposed surface 330*a-d*. In this exemplary embodiment, a right angle shoulder 338*a* (FIG. 10) and a set of curved shoulders 338*b-d* (FIGS. 11-13) provide a transition surface from the corresponding glazing opening facing surface 332*a-d* and the exposed surface 330*a-d*. In this exemplary embodiment, the glazing opening facing surface 332*a-d* includes at least portion that is recessed from the outer extent 340*a-d* of the glazing assembly, generally designated 342, within a recessed region 337*a-d*. The recessed regions may be completely filled with corresponding members of the overlay 314 as described below and as shown in FIGS. 10-13 or partially filled. The recessed regions 337*a-d* may be introduced into the wood glazing border members 316, 318, 320, 322 as a single or series of relief cuts, rabbets, rebates, notches, grooves, step cuts, or otherwise machined during the assembly process. Such relief cut is preferable to accommodate the thickness of the overlay described below.

The glazing assembly 342 in this example is a dual pane window or insulated glass unit (IGU) with an inner pane 344 and an outer pane 346 separated by a spacer 348*a-d* and bounded by a silicone molded seal 350*a-d*. The space between the panes may be vacuum, or filled with air, Argon, or other gas. The interior stop sections 334*a-d* includes an interior stop 352*a-d* either integral with or secured against the respective interior stop section to provide an interior inhibitor against the glazing assembly 342 moving inwardly to the interior 306 (FIGS. 8B-8C) of the structure 304 when mounted within the rough opening 302 relative to the glazing border 312.

Referring now to FIGS. 9-13, the inner overlay 314 includes a number of ferrous-based material components or members including a laterally projecting bottom rail 360, an opposing laterally projecting top rail 362, and a pair of opposing left and right stiles 364, 366, respectively spanning the gap between the top and bottom rails. The inner overlay members 360, 362, 364, and 366 generally correspond to their respective glazing border counterparts 316, 318, 320, and 322, respectively. In this exemplary embodiment, the overlay is preferably constructed of ferrous-based material such as angle iron, chosen for its superior structural strength, although other suitable ferrous-based materials may be used. The sash components 360, 362, 364, and 366 are joined together by welding the adjacent components together at their respective corners to define a structurally integral framework for the glazing border with an opening 367 that generally aligns with glazing opening 324 when the inner overlay 314 and glazing border 312 are brought together. The overlay components may be mitered, straight cut, or abutted together with other suitable joints.

As shown in FIGS. 10-13, each inner overlay member 360, 362, 364, and 366 includes a corresponding first leg 368*a-d* and a second leg 370*a-d* projecting at a right angle to the first leg. The first leg includes a glazing opening facing surface 372*a-d* while the second leg includes an exterior facing surface 374*a-d*. Opposing these surfaces 372*a-d* and 374*a-d* is an interior overlay surface 376*a-d* that complements at least a portion of the respective glazing opening facing surface 332*a-d* and the transition shoulder 338*a-d*, as well as at least a portion of the exposed surface 330*a-d* of the respective glazing border components 316, 318, 320, and 322 of the glazing border 312 such that each overlay member 360, 362, 364, and 366 may be placed in a close abutting relationship with its corresponding border component 316, 318, 320, and 322. In this exemplary embodiment, the second leg 370*a* of the bottom rail 360 extends all the way to the outward facing surface 328*a* of the glazing border bottom rail 316 and then turns inwardly to cover a portion of the outward facing surface 328*a*. The intermediary section of the second leg 370*a* may provide a reinforced kick plate area if desired.

In this exemplary embodiment, the first leg 368*a-d* of each inner overlay component 360, 362, 364, and 366 extends at least partially between the glazing assembly 342 and the glazing opening facing surface 332*a-d* of the glazing border 312. This provides a firm mounting surface for securing the glazing assembly 342. However, this is not meant to be limiting and the first leg may extend a shorter distance across the glazing opening facing surface 332*a-d* without extending between the glazing assembly and the glazing opening facing surface. It will also be appreciated that the glazing opening surfaces 372*a-d* do not extend into the glazing opening 324 so as not to interfere with the sightlines, defined by a plane 355*a-d* passing through the innermost extents 353*a-d* and 383*a-d* of the corresponding inner stops 352*a-d* and outer stops 382*a-d*, respectively, through the glazing assembly 342. In this exemplary embodiment the first legs 368*a-d* are disposed at least partially between the silicone seal 350*a-d* and the glazing opening facing surfaces 332*a-d* within the recessed regions 337*a-d*.

With continued reference to FIGS. 9-13, the second leg 370*a-d* of the inner overlay 314 extends at a right angle from the corresponding first leg 368*a-d* and covers at least a portion of if not the entire exposed surface 330*a-d* of the glazing border 312 in each view as shown in FIGS. 8A-C and FIGS. 10-13. However, in the bottom rail view (FIG. 10), the second leg 370*a* extends slightly past an outermost edge 378*a* of the glazing border and into the gap 390*a* between the inner sub-assembly 310 and the threshold portion 460 of the outer sub-assembly 410. In the top rail view (FIG. 11), in the jamb detail—hinge side view (FIG. 12), and jamb detail—off hinge side view (FIG. 13), the second leg 370*b-d* terminates at a position flush with the outer facing surface 378*b-d* of the glazing border 312.

The inner overlay 314 is typically constructed to match the corresponding inner perimeter region made up of the interior facing glazing opening surface 332*a-d* and exposed surface 330*a-d* and the transition 338*a-d* therebetween to maintain the sight lines through the glazing panes 344, 346 as large as possible, typically preserving the original sightlines even after the overlay 314 is assembled to the glazing border 312, while still providing the structural framework for the glazing border 312.

In addition to the interior stop 352*a-d*, an exterior stop 382*a-d* may be employed to secure the glazing assembly 342 in place from the exterior. The exterior stop may be integral with the overlay or secured thereto. This exterior stop may be constructed of a ferrous-based material as with the overlay or, alternatively, aluminum, or other suitable weather resistant material and finished to match or stand out from the exterior surface 374*a-d* of the inner overlay 314.

With reference to FIGS. 9-13, the glazing border 312 may be slip fit into the inner overlay 314 resulting in the interior surfaces 376*a-d* of the first and second legs 368*a-d*, 370*a-d*, respectively, of the inner overlay directly abutting and covering at least a portion of and preferably all of the exposed surface 330*a-d* of the glazing border 312 and the transition shoulder 338*a-d*, as well as at least a portion of and preferably all of the glazing opening facing surface 332*a-d*. In other words, any portion of the glazing border 312 that may be exposed to the elements when the inner sub-assembly 310 is secured to the building structure 304 (FIGS. 8B-8C) through a connection to the outer sub-assembly 410 and within the rough opening 302 is preferably covered by the overlay 314. Alternatively, the inner overlay 314 may be slip fit over the glazing border 312 without any need to flex the first and second legs 368*a-d* and 370*a-d*, respectively. In this exemplary embodiment, no air gaps exist between these overlay and border surfaces. As the inner overlay 314 provides the structural integrity of the inner sub-assembly 310, the non-ferrous based material such as wood may be constructed with less thickness than a conventional wooden door if desired thereby reducing the amount of expansion and contraction and overall thickness of the inner sub-assembly 310 and thus the composite fenestration assembly 300.

To secure the inner overlay 314 to the glazing border 312, a layer of structural adhesive similar to adhesive 184 in FIG. 7 suitable for bonding a ferrous based material to a non-ferrous based material may be employed to bond the two components together. The bonding components may be suitably prepared prior to applying the adhesive. In some instances, a series of grooves 386*a-c* as, for example, shown in FIG. 11, may be introduced into the glazing opening facing surface 332*a-d* to provide an overflow reservoir for the adhesive for a better bonding event. Alternatively, grooves may be introduced into the interior surface of the inner overlay or both the ferrous based and non-ferrous based materials. Such structural adhesive preferably alleviates the need for mechanical fasteners but such fasteners such as screws, bolts, and nails may be used as well or as an alternative to the adhesive. The structural adhesive and rigidity of the inner overlay 314 also ensures minimal wood movement. With the protective inner overlay 314 affixed to the glazing border 312, the structural integrity of the inner overlay 314 allows for the inner sub-assembly 310 to be secured by fastening just the inner overlay to the outer sub-assembly 410. In other words, no mounting or fastening hardware need penetrate the glazing border in order to secure the inner sub-assembly 310 to the outer sub-assembly, although this is not meant to be limiting and hardware may project into or through the glazing border as well as, for example, the hinge 394 in FIG. 12.

With the exception of the bottom rail overlay member 360, it will be appreciated that each inner overlay member 362, 364, 366 in this exemplary embodiment does not incorporate any opposing surfaces and is therefore unlike the clamping style claddings in other doors. The interior surfaces 376*a-d* of the inner overlay 314 are smooth with a generally planar interior surface of the first legs 368*a-d* and a generally planar interior surface of the second legs 370*a-d* with a sharp right angle shoulder 338*a* or curved shoulder transitions 338*b-d* therebetween. No catches or hooks are needed on the interior surface 376*a-d* or anywhere on the inner overlay members 360, 362, 364, 366 to secure the overlay 314 to the glazing border 312 as a structural adhesive is all that is necessary. No other mechanical fasteners are needed but may be used if desired and their omission is not meant to be limiting.

The Outer Support Structure Sub-Assembly (Outer Frame): In addition to the inner support structure sub-assembly 310, an outer support structure sub-assembly or outer sub-assembly, generally designated 410, may be provided. The construction of the outer support structure sub-assembly is similar in many instances to the glazing support structure sub-assembly 310. However, the two sub-assemblies 310, 410 serve different functions. The inner support structure sub-assembly 310 primarily serves to define one or more glazing openings 324 and support one or more glazings or windowpanes 344, 346 within a door and then be connected in some manner, either fixed to or moveable relative to the outer support structure sub-assembly 410. The outer support structure sub-assembly 410, on the other hand, is constructed to serve the connection between the building structure 304 and the inner support structure sub-assembly 310. Typically, the outer support structure sub-assembly is referred to as the frame that is connected to the rough framing of the rough opening 302 (FIGS. 8B-8C). The inner support structure sub-assembly 310 is often referred to as the door.

Referring back to FIG. 9, the outer sub-assembly 410 comprises two primary components, an outer border 412 or frame and an outer overlay 414 providing the structural framework for the outer border. It will be appreciated that this is the opposite of a dual material conventional window such as a wood frame window with aluminum cladding wherein the wooden frame provides the structural framework and the non-structural aluminum cladding is merely a decorative outer surface providing a weather resistant cover for the otherwise exposed exterior wood surface.

As shown in FIG. 9, the outer border 412, also referred to as the door frame in this example, includes a number of non-ferrous based material components or members including a laterally projecting top head jamb 418, and a pair of opposing left and right jambs 420, 422, respectively, spanning the gap between the top and bottom rails. In this exemplary embodiment, the border is preferably constructed of wood or a wood-based material, chosen for its superior thermal insulation characteristics. The frame components 418, 420, and 422 may be joined together using conventional door frame construction techniques and define an inner sub-assembly opening 624 therebetween. It will be appreciated that the door construction is somewhat different than the window construction as a highly trafficked threshold replaces a sill. In other words, there is no wooden counterpart in the bottom of the outer border spanning between the two jambs. Instead, in this door example, sill of the window is replaced by a stringer or flange 397*d* that connects the bottom edges of the opposing nail fins 397*b*, 397*c* for receiving a threshold component 460 described below. The stringer component 397*d* may be part of the assembled frame 412 or installed separately.

Figure 11:
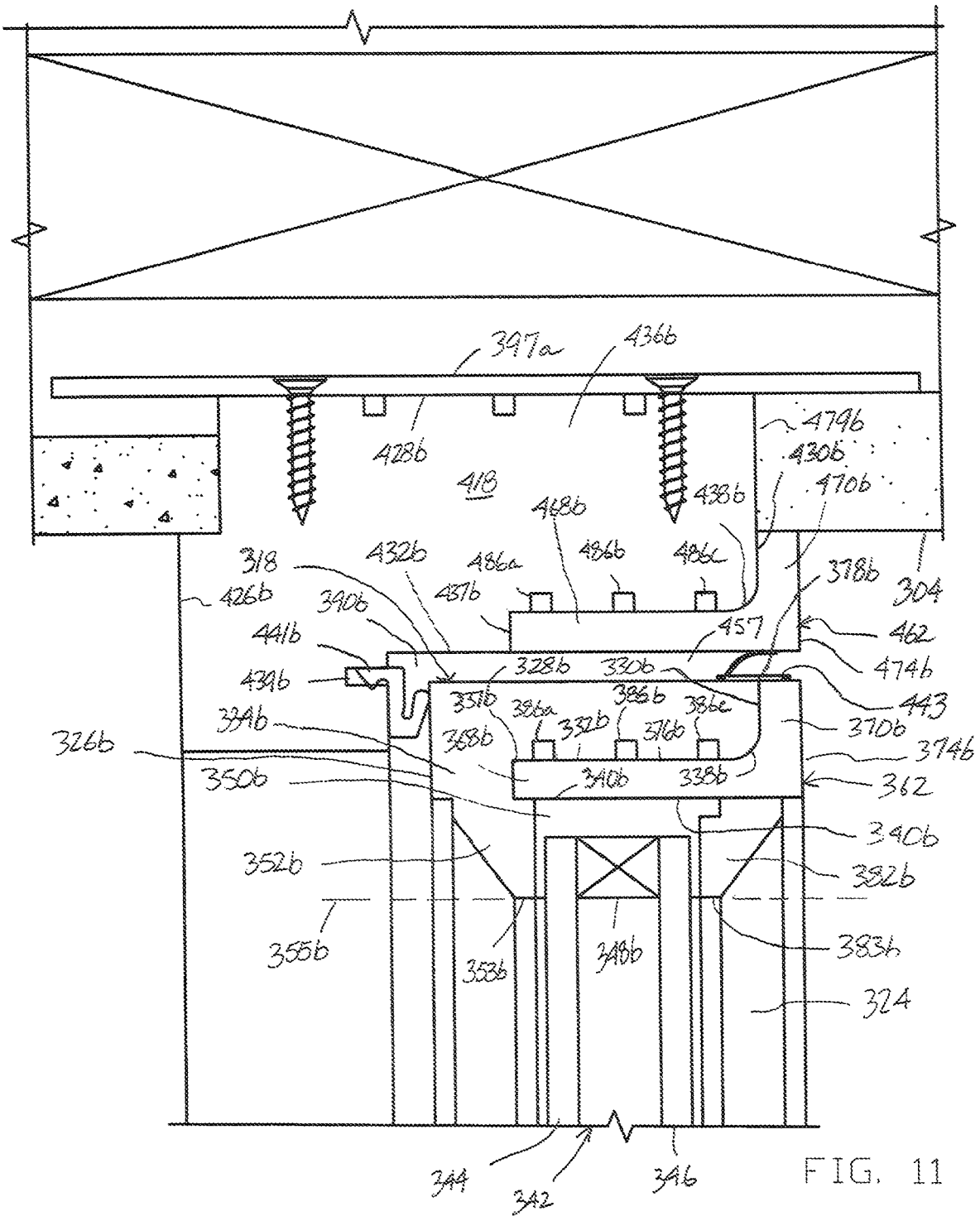
FIG. 11 is a cross-sectional view taken from section line 11-11 of FIG. 8A depicting the head detail in enlarged scale.
Figure 12:
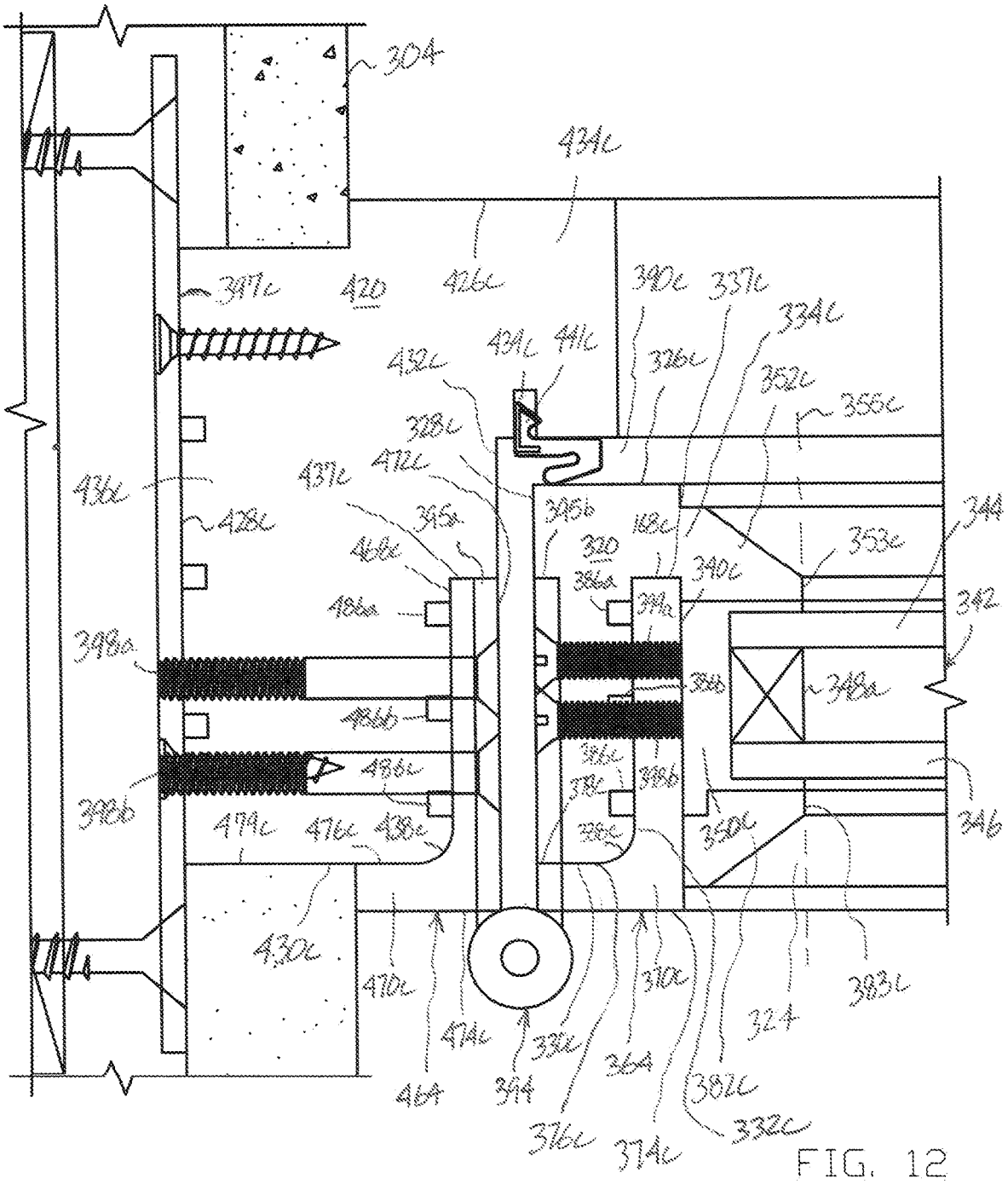
FIG. 12 is a cross-sectional view taken from section line 12-12 of FIG. 8A depicting the left side jamb detail in enlarged scale.
Figure 13:
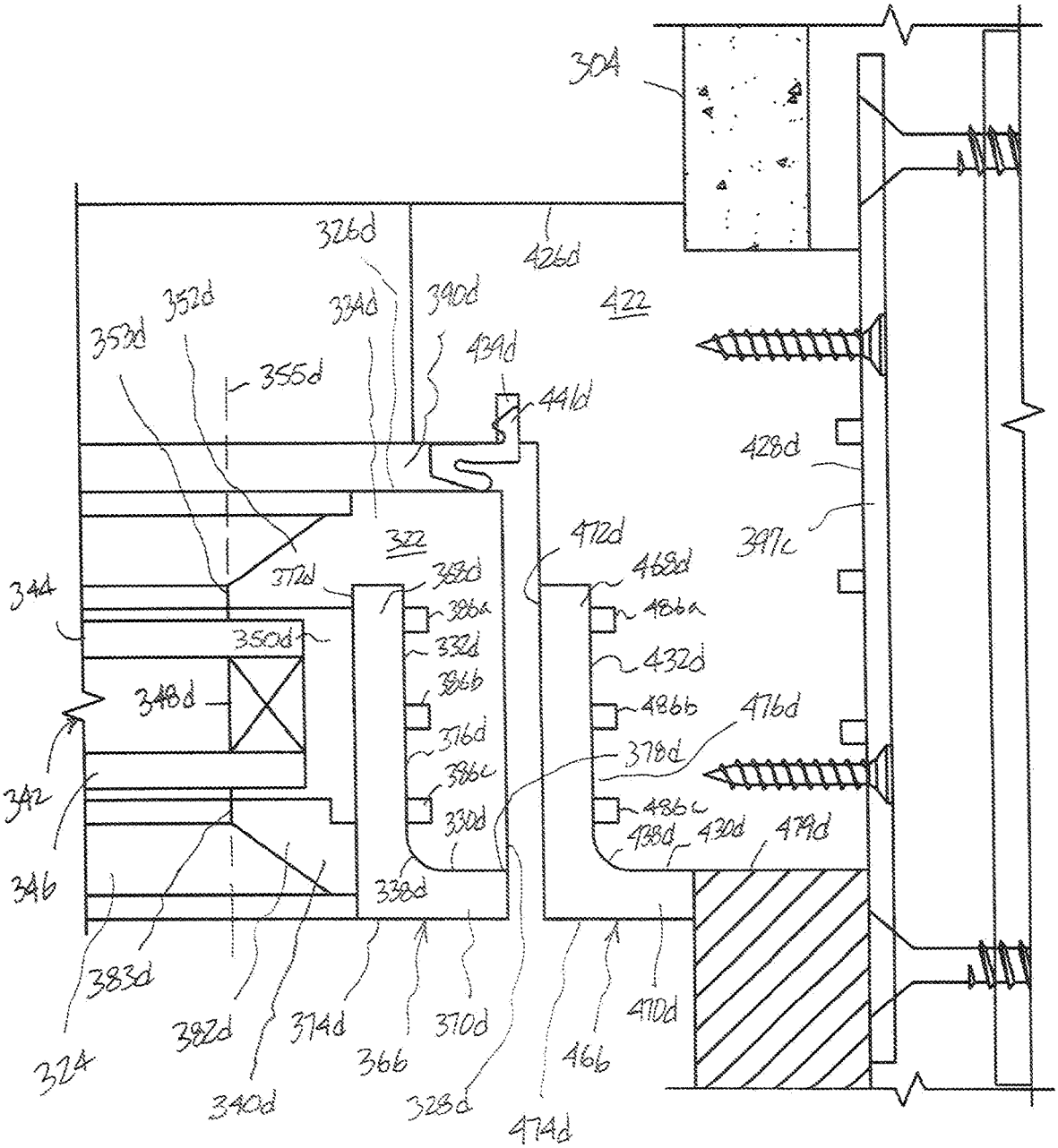
FIG. 13 is a cross-sectional view taken from section line 13-13 of FIG. 8A depicting the right side jamb detail in enlarged scale.

As shown in FIGS. 11-13, each frame member 418, 420, and 422 includes an interior facing surface 426*b-d*, an outward facing surface 428*b-d*, an exterior facing surface 430*b-d*, and an inner sub-assembly opening facing surface 432*b-d* that coincides with the glazing opening facing surface 332*b-d* of the glazing border 312. Like its counterparts in the glazing border 312, the interior facing surfaces 426*b-d* of the frame members 418, 420, and 422 define a decorative surface that is responsible for presenting the preferred interior view when the outer sub-assembly 410 is mounted within the rough opening 302. In this example, the decorative surface is merely the interior surface of the wooden frame. It could also be a veneer added to the interior surface or decorative inlay. However, the interior surface may incorporate other decorative profiles as well such as commonly used in door framing. In this exemplary embodiment, the interior surfaces 426*b-d* are generally planar and project parallel with a vertical plane passing through the rough opening 302 in the building structure 304.

With continued reference to FIGS. 11-13, the outward facing surfaces 428*b-d* face the rough framing surrounding the rough opening 302 of the structure 304 (FIGS. 8B-8C)

and generally provides a surface for mounting the door frame 412 to the rough framing using conventional door mounting techniques. The exterior facing surface 430*b-d* of each frame member 418, 420, and 422, respectively, also referred to as the exposed surface since such surface would otherwise be exposed to the elements when the outer sub-assembly 410 is mounted within the rough opening, is a generally planar surface paralleling the interior surface 426*b-d*. Such exposed surfaces generally require a weatherproof covering constructed of a non-ferrous based material such as wood commonly used in window and door units. The inner sub-assembly opening facing surfaces 432*b-d* face inwardly toward the inner sub-assembly opening 424 and are generally divided into two sections. For the top rail and left and right jamb sections, the first section is the interior block section 434*b-d* and the second adjacent mounting hardware section 436*b-d* projects outwardly from the interior block section and extends toward the exposed surface 430*b-d*. Curved shoulders 438*b-d* provide a transition surface from the corresponding inner sub-assembly opening facing surface 432*b-d* and the exposed surface 430*b-d*. In this exemplary embodiment, the inner sub-assembly opening facing surface 432*b-d* within the mounting section 436*b-d* includes a recessed region 437*b-d* in the top rail, left jamb, right jamb members 418, 420, and 422, respectively. The recessed region may be introduced in a manner using the same or similar process for the glazing borders 112, 312 above. Such relief cut is preferable to accommodate the thickness of the overlay described below. The interior block sections 434*b-d* also include a slot 439*b-d* for receiving a weatherproofing seal or strip 441*b-d* that extends between the inner and outer sub-assemblies 310 and 410.

Figure 10:
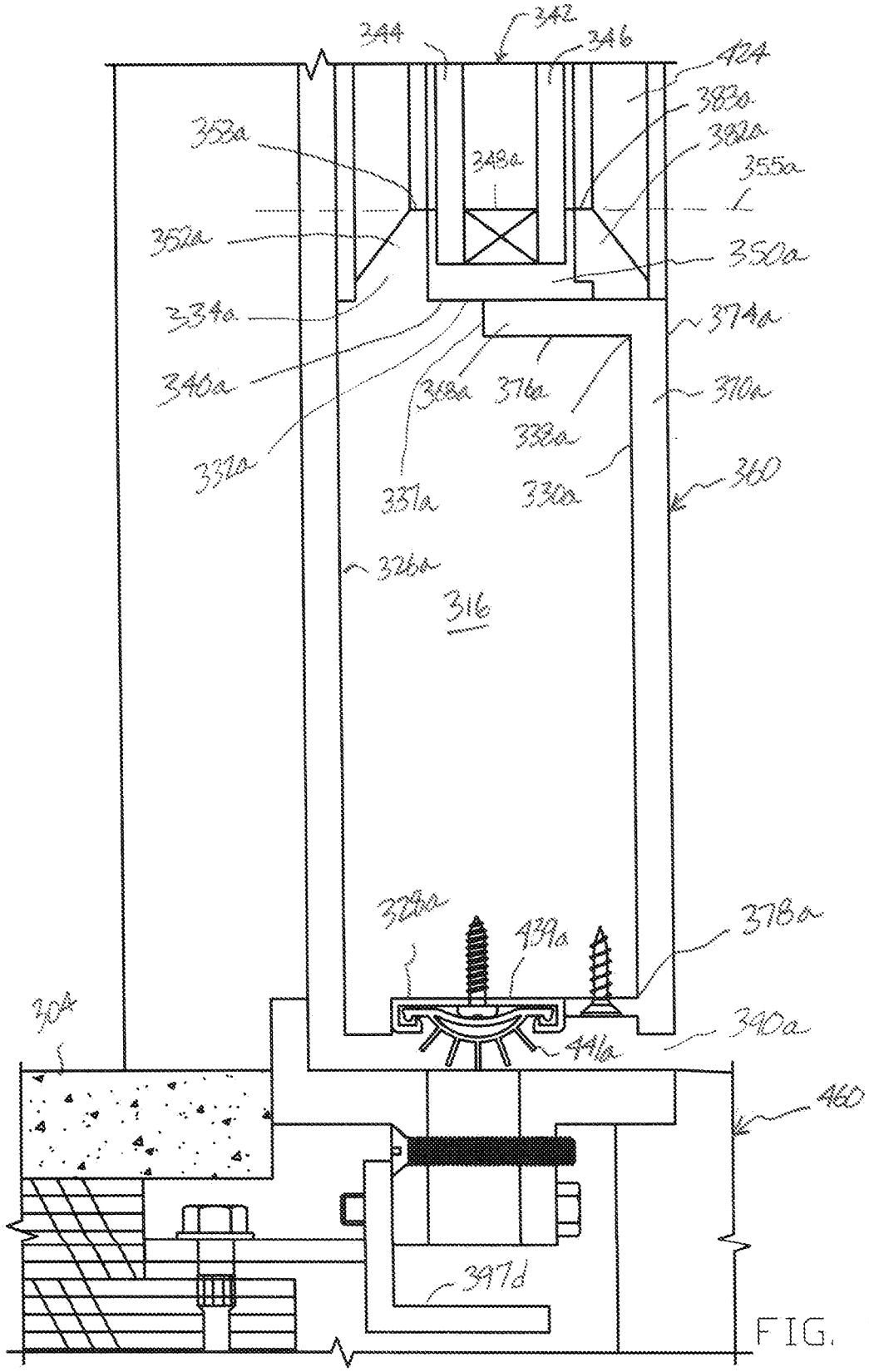
FIG. 10 is a cross-sectional view taken from section line 10-10 of FIG. 8A depicting the sill detail in enlarged scale.

As shown in FIGS. 9-10, a bottom threshold, generally designed 460, may be inserted above the stringer 397*d* and connected thereto as would be familiar to one or ordinary skill in the art.

Referring now to FIGS. 8A-13, the outer overlay 414 includes a number of ferrous-based material components or members including a laterally projecting threshold 460, an opposing laterally projecting head 462, and a pair of opposing left and right jambs 464, 466, respectively spanning the gap between the head and sill. The outer overlay members 462, 464, and 466 generally correspond to their respective outer frame counterparts 418, 420, and 422, respectively, with the threshold component 460 covering the flange 397*d* at the bottom of the assembly when fully assembled. In this exemplary embodiment, the outer overlay 414 is preferably constructed of ferrous-based material such as angle iron, chosen for its superior structural strength. The outer overlay components 460, 462, 464, and 466 may be joined together by welding the adjacent components together at their respective corners to define a structurally integral framework for the frame with an outer overlay opening 467 (FIG. 9) that generally aligns with frame opening 424 when the outer overlay 414 and outer frame 412 are brought together. The outer overlay components 460, 462, 464, and 466 may be mitered, straight cut, or abutted together with other suitable joints. Alternatively, the threshold 460 may be constructed of a different material and/or installed separately before or after the head 462 and jambs 464, 466 are installed.

As shown in FIGS. 11-13, each outer overlay member 462, 464, and 466 includes first leg 468*b-d* and a second leg 470*b-d* projecting at a right angle to the first leg. The first leg includes an inner sub-assembly facing surface 472*b-d* while the second leg includes an exterior facing surface 474*b-d*. Opposing these surfaces 472*b-d* and 474*b-d* is an interior outer overlay surface 476*b-d* that complements at least a portion of the inner sub-assembly opening facing surface 432*b-d* and transition shoulder 438*b-d*, as well as at least a portion of the exposed surface 430*b-d* of the outer frame 412. It will be noted that, in this exemplary embodiment, the threshold overlay 460 construction may be conventional as there no wooden counterpart in the outer frame 412.

Like the embodiments above, the first legs 468*b-d* of the outer overlay 414 extends parallel to the outward facing surface 328*b-d* of the glazing border 312 stopping short of the first block section 434*b-d*. In this exemplary embodiment, the first legs 468*b-d* extend toward the first block section to match innermost projection of the first legs 368*b-d* of the inner overlay 314 as shown FIGS. 11-13. However, this is not meant to be limiting and the first leg may extend more or less than this distance. The second legs 470*b-d* of the outer overlay extends at a right angle from the first leg and covers the entire exposed surface 430*b-d* of the outer frame 412 in each view as shown in FIGS. 11-13 except for a return region 479*b-d* where another building component such as molding, stucco, or other covering will cover and protect that portion of the outer frame from the elements.

The outer overlay 414 is typically constructed to match the corresponding inner perimeter region of the outer frame 412 made up of the interior facing inner sub-assembly opening surface 432*b-d* and exposed surface 430*b-d*, and the transition 438*b-d* while not interfering with the sight lines in the inner sub-assembly 310.

With reference to FIGS. 9-13, the outer frame 412 may be slip fit into the outer overlay 414 resulting in the interior surfaces 476*b-d* of the first and second legs 468*b-d* and 470*b-d*, respectively, of the outer overlay 414 directly abutting and covering at least a portion of and preferably all of the exposed surfaces 430*b-d* of the outer frame 412 and the transition shoulders 438*b-d* except for the return regions 479*b-d*, and at least a portion of the inner sub-assembly opening facing surfaces 432*b-d*. In other words, the outer overlay 414 covers any portion of the outer frame 412 that may be exposed to external elements when the outer sub-assembly 410 is secured to the building structure 304 within the rough opening 302 (FIGS. 8B-8C). Alternatively, the outer overlay 414 may be slip fit over the outer frame 412 with any need to flex the first and second legs 468*b-d* and 470*b-d*, respectively. In this exemplary embodiment, no air gaps exist between these outer overlay and outer frame surfaces. As the outer overlay 414 provides the structural integrity of the outer sub-assembly 410, the non-ferrous based material such as wood may be constructed with less thickness than a conventional wooden window if desired thereby reducing the amount of expansion and contraction and overall thickness of the outer sub-assembly 410 and thus the composite fenestration assembly 300.

To secure the outer overlay 414 to the outer frame 412, a layer of structural adhesive similar to the adhesive 184 in FIG. 7 may be employed to bond the two components together. The bonding components may be suitably prepared prior to applying the adhesive. In some instances, a series of grooves 486*a-c* as for example shown in FIG. 11 may be introduced into the glazing opening facing surface 432*b-d* to provide an overflow reservoir for the adhesive for a better bonding event. Alternatively, grooves may be introduced into the interior surface of the inner overlay or both. As with the inner overlay 314 and glazing border 312, such structural adhesive preferably alleviates the need for mechanical fasteners but such fasteners such as screws, bolts, and nails may be used as well or as an alternative to the adhesive. The structural adhesive and rigidity of the outer overlay 414 also ensures minimal wood movement. With the protective overlay 414 affixed to the outer frame 412, the structural integrity of the overlay allows for the outer sub-assembly 410 to be secured by fastening just the overlay 414 to the structure 304 (FIGS. 8B-8C). In other words, no mounting or fastening hardware need penetrate the outer frame in order to secure the outer sub-assembly 410 to the outer sub-assembly, although this is not meant to be limiting and hardware may project into or through the outer frame 414 as well as shown, for example, by nail fin 397*a* in FIG. 11.

It will be appreciated that the outer overlay 414 does not incorporate any opposing interior surfaces and is therefore unlike the clamping style claddings in other windows. The interior surfaces 476*b-d* of the outer overlay 414 are smooth with a generally planar interior surface of the first legs 468*b-d* and a generally planar interior surface of the second legs 470*b-d* with curved transition shoulders 438*b-d* therebetween. No catches or hooks are needed to secure the overlay to the glazing border as a structural adhesive is all that is necessary. No other mechanical fasteners are needed but may be used if desired and their omission is not meant to be limiting.

In addition to the inner and outer sub-assemblies 310, 410, respectively, several other fenestration related components may be incorporated into a final installation within the rough opening 302. These include weatherproofing components, installation and mounting hardware, and pane dividing features such as muntins.

Referring now to FIGS. 10-13, several weatherproofing components may be incorporated between the inner sub-assembly 310 and the outer sub-assembly 410. For example, in FIG. 10, a threshold side weatherstrip or sweep 441*a* includes a first section engaged in slot or sweep track 439*a* and a second section filling up a gap 390*a* between the bottom surface 328*a* of the glazing border 312 and the top surface of the threshold 460. Similarly, in FIG. 11, a head side weatherstrip 441*b* includes a first section engaged in slot 439*b* and a second section filling up a gap 390*b* between the interior surface 326*b* of the glazing border 312 and the interior block section 434*b* of the outer frame 414. Also, in FIG. 11 is another weatherstripping component 443 disposed in the gap 457 between the top surface 328*b* of the inner sub-assembly 310 and the first leg 468*b* of the head 418 of the outer sub-assembly 410.

Also, in FIG. 12, a left side jamb weatherstrip 441*c* includes a first section engaged in slot 439*c* and a second section filling up a gap 390*c* between the interior surface 326*c* of the glazing border 312 and the interior block section 434*c* of the outer frame 414. In FIG. 13, a right side jamb weatherstrip 441*d* includes a first section engaged in slot 439*d* and a second section filling up a gap 390*d* between the interior surface 326*d* of the glazing border 312 and the interior block section 434*d* of the outer frame 414. Such weatherstripping inhibits the passage of air between the interior and exterior of the structure when the composition fenestration assembly 300 is secured within the rough opening 302 and in a closed configuration. Additional weatherproofing components such as caulking, insulating foam, mohair strips, weatherproof paper, decorative molding, flashing, and the building finish may also contribute to weatherproofing the composite fenestration assembly and assist in improving the insulation characteristics of the building in the which the composite fenestration assembly is mounted. The location and securement of such weatherproofing components is well known and within one of ordinary skill in the art.

In addition to the weatherproofing components, various door installation hardware such as locks and latches, handles, hinges, bolts, rollers, hangers, strike plates, sweeps, nail fins, clips, and brackets, balances, levers, door closer, to name a few without being limiting. Such hardware may generally be grouped into hardware either fixedly or movably connecting the inner sub-assembly 310 to the outer sub-assembly 410 and hardware connecting the outer sub-assembly 410 to the framing defining the rough opening 302. For example, turning now to FIG. 10, there is no hardware connecting the inner sub-assembly 310 to the outer sub-assembly 410. Similarly, in FIG. 11, there no hardware connecting the inner sub-assembly 310 to the outer sub-assembly 410 but a nail fin 397*a* is secured to the outward facing surface 428*b* of the head 418 of the outer sub-assembly 410. Such nail fin may be nailed to the framing surrounding the rough opening 302 as would be understood by one of ordinary skill in the art.

Turning now to FIG. 12 a hinge 394 with a first leaf 395*a* connected to the left side jamb 420 of the outer sub-assembly 410 and a second leaf 395*b* connected to the outer facing surface 328*c* of the left stile 320. As shown in FIG. 12 the hinge leaves 395*a-b* are connected to their respective fenestration components 320, 420 using fasteners such as screws 398*a-b* or bolts 399*a-b*. Where a first leg of either overlay 314, 414 is disposed within the connection path, the first leg may be modified to accommodate the passthrough of such fasteners such as drilling a hole. In addition to the hinge 394, a nail tin 397*b* with an L-shaped construction similar to the nail fin 397*a* (FIG. 11) may be used to secure the left side jamb 420 to the framing defining the rough opening 302. In addition, a backing plate (not shown) may be employed at the distal end of the fasteners to provide a stronger connection if desired. In FIG. 13, the off-hinge side of the composite fenestration assembly 300, another nail fin 397*c* may be used to secure the right side jamb 422 to the framing defining the rough opening 102 as well.

Figure 14:
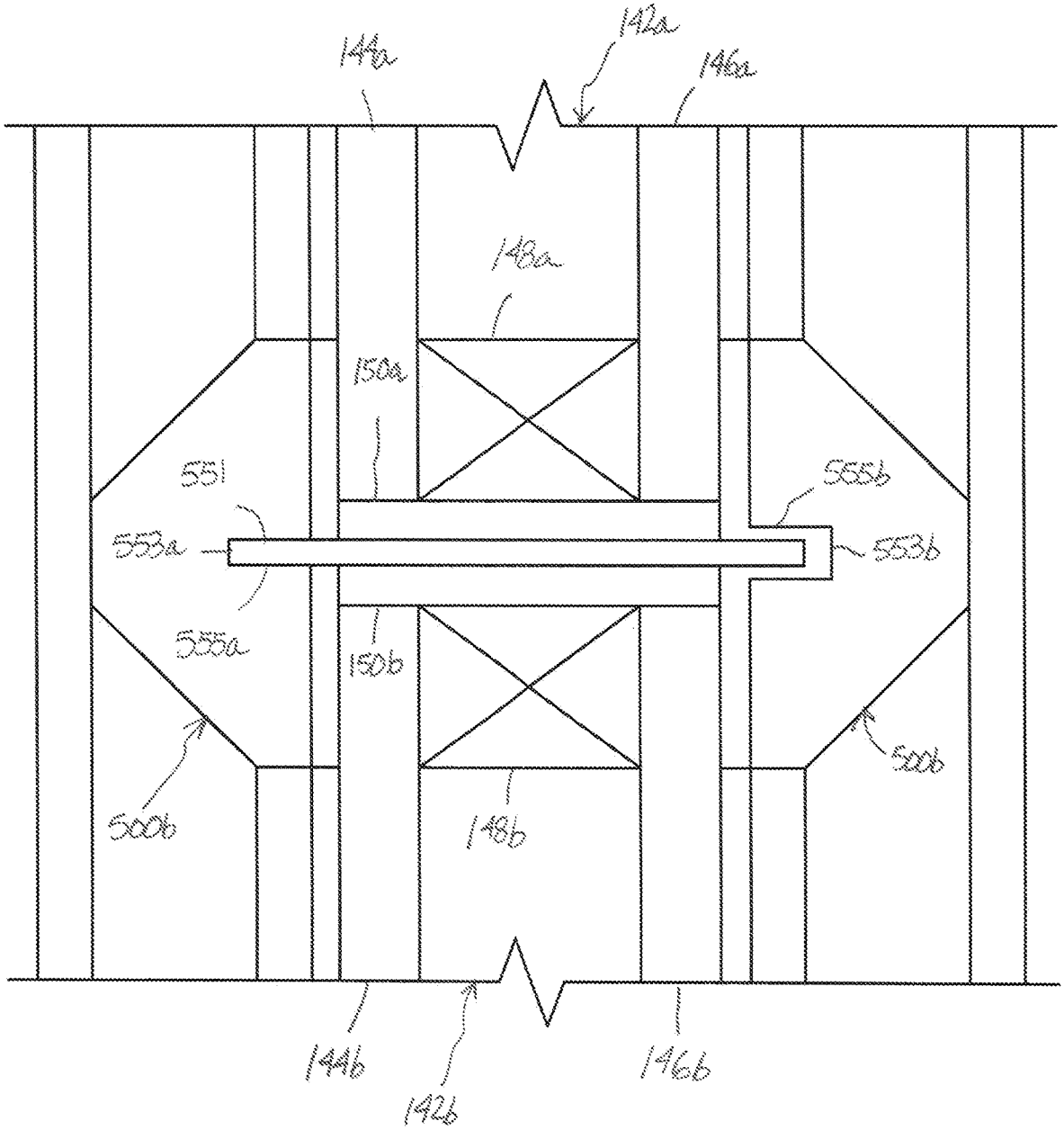
FIG. 14 is a cross-sectional view taken from section line 14-14 of either FIG. 1A or FIG. 8A depicting a muntin detail in enlarged scale.

Turning now to FIG. 14, an exemplary set of decorative interior and exterior muntins, generally designated 500*a*, 500*b*, may be used to divide up the inner and outer glass panes of the glazing assembly to form separates lites (or lights) in the viewing area. It will be appreciated that the construction of the muntins 500*a*, 500*b* is same for the muntins taken from circle 1 of either FIG. 1A or FIG. 8A, whether discussing a window or a door. For ease of description, an exemplary embodiment of a set of window muntins 500*a*, 500*b* taken from circle Z1 of FIG. 1A will now be discussed. The interior and exterior muntins 500*a*. 500*b* form a division between two adjacent glazing assemblies 142*a*, 142*b* each with their own inner and outer glass panes 144*a*. 144*b* and 146*a*. 146*b*, respectively. Spacers 148*a*. 148*b* are used to maintain separation between the glass panes while a silicon form 150*a*, 150*b* seals the outer ends of the glazing assemblies. Projecting between the seals is a thin flat dowel or bar 551 that runs the length of the muntin bar that juts out at opposing ends 553*a*, 553*b* beyond the outermost surfaces of the glass panes to provide a ledge or post to receive an interior muntin 500*a* and the exterior muntin 500*b*, respectively. Both muntins include a receptacle 555*a*, 555*b* for receiving the post 553*a*. 553*b*, respectively. The interior muntin is typically constructed of the same material as the glazing border but this is not meant to be limiting. The exterior muntin is typically constructed of aluminum that is metallized to present a similar exterior appearance as the overlays 114, 214 314, 414 but this is not meant to be limiting. The dowel may be constructed of wood, metal, or fiberglass. It will be appreciated that this configuration results in true divided lites. Alternatively, the muntins may be in the form of a grille that is pressed on top of the corresponding windowpane and secured thereto using an adhesive or a friction fit by snapping the muntins into place. Such muntin construction creates simulated divided lites as the associated windowpane is not truly separated between the muntins. As used herein, grille refers to windowpane dividers or muntins or muntin bars. These may be fitted to the exterior surface of the pane and removable for cleaning. Also, grilles may be fitted inside the sealed insulating glass unit.

Materials: As discussed above, the glazing borders 112, 312 and outer frames 212, 412 are typically constructed of a non-ferrous material such as wood, vinyl, or fiberglass or other suitable material and selected for both a pleasing interior facing surface and preferred thermal insulation qualities.

On the other hand, the inner overlays 114, 314 and outer overlays 214, 414 are preferably constructed of steel, a steel alloy, or angle iron. The overlay material is preferably selected to provide a rigid, self-supporting structure capable of providing the structural framework for the glazing border and outer frame. Self-supporting is defined as being capable of maintaining an upright orientation without collapsing under its own weight or maintaining a horizontal orientation without appreciably bending. This is unlike aluminum cladding which would collapse or bend under its own weight. In addition, the overlays are preferably constructed from solid and unbroken angle iron. It will be appreciated that holes or slots may be included in the overlays where mechanical fasteners are used. The overlay material is also preferably constructed to present a pleasing external architectural appearance, often vintage in appearance to match the appearance of all steel windows. The combination of a wood glazing border and outer frame and steel or angle iron overlays satisfies these preferences. In addition, the thermal insulating characteristics of the metal overlay directly abutting the wood material avoid the need for introducing a thermal break in the overlay or between the overlay and glazing borders and/or outer frames. More specifically, the thermal coefficient Uf (thermal coefficient of the border or frame also referred to as the U-factor or U-value) of the first material used for constructing the glazing borders and the outer frames is much lower than the thermal coefficient Uf of the overlay material. Moreover, the combined thermal coefficient Uf of first and second materials (for example wood and steel/angle iron) is an improvement (lower than) over both a wood frame-aluminum clad window, with or without air gaps between the materials as well as an all metal frame separated by a thermal break and filled with an insulating material.

In general, the U-Factor or U-value measures the rate of heat transfer and informs how well the window insulates. U-factor values generally range from 0.25 to 1.25 and are measured in Btu/h*ft$^2$ degrees F. The lower the U-factor, the better the window insulates. U-factor may be divided in Ug for the surface of the glass and Uf for the surface of the casing or frame and Uw being the combination of Ug and Uf representing the total coefficient of heat transmission. In these exemplary embodiments, the primary focus is on Uf for the border, overlay, and combination.

The glazing assemblies 142, 342 may be constructed of conventional glass panes and may incorporate one or more panes with spacers employed in dual or triple pane constructions. The space between the multiple pane sets may either be a vacuum or filled with air or a gas such as Argon.

The exterior stop blocks may be constructed of aluminum or other suitable material that may be finished to resemble the appearance of the exterior face of the overlay. Likewise, the muntins may be constructed of a similar material. Typically, the exterior stop blocks and muntins are constructed separately from the overlays and secured during assembly or installation. The interior stop blocks are typically constructed of the same material as the glazing borders and outer frames and generally machined as part of the constructed process and thus integral with the rest of rest of the glazing borders and outer frames. However, it will be appreciated that the interior stop blocks may be a separate component and secured to the glazing borders and/or outer frames using conventional window and door construction techniques.

Figure 15:
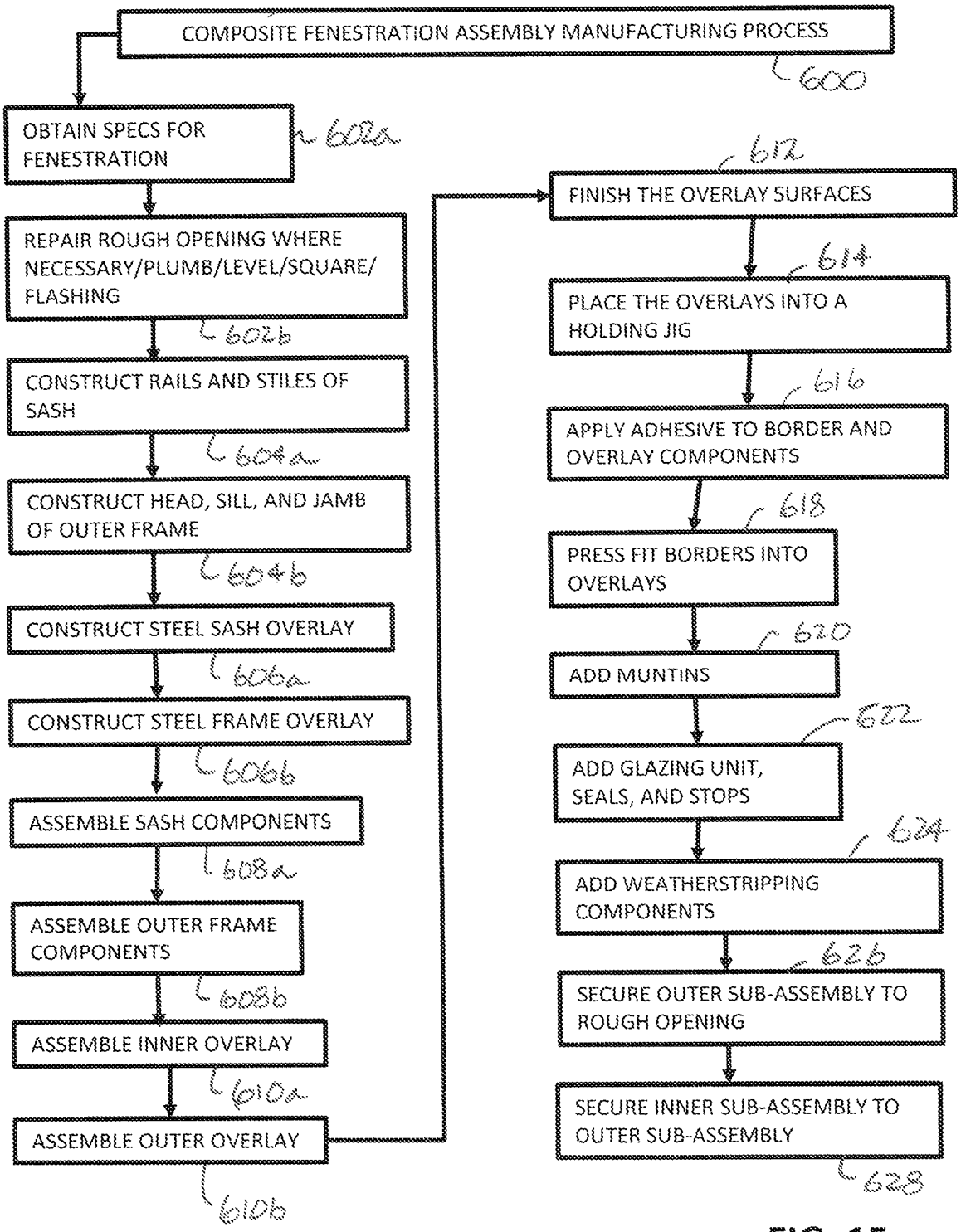
FIG. 15 is a process diagram illustrating an exemplary manufacturing process.

Exemplary Assembly and Installation of a Composite Fenestration: Referring now FIGS. 1A-7 and 15, an exemplary method, generally designated 600, of assembling a composite fenestration will now be described with the assumption that the glazing border 112 and outer frame 212 are constructed of wood and the inner overlay 114 and outer overlay 214 are constructed of angle iron. It will be appreciated that the construction of other embodiments discussed herein involves similar steps. Turning now to FIG. 15, in step 602*a*, the specifications of the rough opening, lighting requirements, and design are obtained either by direct measurement at the job site or from a set of architectural plans or blueprints or other set of criteria from the customer or end user. In this example, the rough opening 102 (FIGS. 1B-1C) in the structure 104 is assumed to be plumbed, leveled, and squared. However, the installer will ensure such criteria are met before installing as well as replacing and framing wood prior to installation if needed at step 602*b*. The rough opening is preferably constructed to be larger than the outer sub-assembly 210 to allow room for shimming, leveling, and plumbing to ensure a pleasing window appearance.

In step 604*a*, the components 116, 118, 120, and 122 of the glazing border or sash 112 (FIG. 2) may be precision machined using a CNC machine. Similarly, the components 216, 218, 220, and 222 of the outer frame 212 may be precision machined as well at step 604*b*. Other wood border construction methods may be used as well but precision machining is preferred. In step 606*a*, the angle iron components 160, 162, 164, and 166 or each section of the inner overlay may also be machined by shearing one or both legs to the desired length to match or closely resemble the profile of the perimeter region of the glazing border as discussed above. Likewise, in step 806*b*, the angle iron components 260, 262, 264, and 266 or each section of the outer overlay 214 may also be machined by shearing one or both legs to the desired length to match or closely resemble the profile of the perimeter region of the glazing border as discussed above. It will be appreciated that these steps 604*a*, 604*b*, 606*a*, 606*b* may be accomplished consecutively or simultaneously with the corresponding machinery typically required to machine wood and steel. It will be appreciated that the wood components may be machined to match the profile of the angle irons or, alternatively, the angle irons may be machined to match the profile the profile of the wood components.

In step 608*a*, the glazing border 112 may be assembled and typically joined using dowels and glue and other suitable fasteners where necessary. The outer frame 212 may be assembled in a similar manner at step 608*b*. It will be appreciated that, as the overlays provide the structural framework, structural support, or structural integrity for the assemblies given the strength of the ferrous material, it is not necessary to build structural borders and such borders may be made thinner than a conventional wooden frame that provides the structural support of the fenestration if desired.

In step 610*a*, the sash overlay 114 may be assembled by welding adjacent members 160, 162, 164, and 166 where they meet to define a structurally integral support structure for the corresponding glazing border 112, that is, a structural framework. In step 610*b*, a similar process may be used to assemble the outer overlay members 260, 262, 264, and 266 together to form a structurally integral support structure for the corresponding outer frame 212. The inner and outer overlays 114, 214 may be clamped in place, leveled, and plumbed to ensure a particular fit to meet specifications.

In step 612, the surfaces of the overlay components 160, 162, 164, 166, 260, 262, 264, and 266 are finished as desired. For example, angle irons may be hot dipped (galvanized) or metallized. Then, after drying, the angle irons may be colored to add a desired exterior appearance, typically to match architectural specifications or resemble an existing exterior appearance to match existing architecture.

In step 614, the inner overlay 114 may be mounted on a set of sawhorses or other suitable holding jig with the interior facing surface facing up. The outer overlay 214 may be similarly disposed. At step 616, a layer of structural adhesive 184 (FIG. 7) is applied to the interior surface of the inner overlay 114 as well as the outer overlay 214. Such adhesive prevents a lot of movement between the non-ferrous material and ferrous material once cured. Then, in step 618, the glazing border 112 is slip fit into the inner overlay and then tapped or pressed into the inner overlay 114 to form an inner sub-assembly 110. The inner sub-assembly may then be transported as an integral unit once the adhesive cures. The outer sub-assembly 210 may be constructed similarly by slip fitting the outer frame 212 into the outer overlay 214 and allowing the adhesive to cure.

At step 620, decorative elements such as muntins 500*a*, 500*b* shown in FIG. 14 may be added. Then, at step 622, one more glazings 144, 146 (FIGS. 3-6) with their seals 150*a-d* and spacers 148*a-d* may be installed followed by the inner and outer stops 152*a-d*, 182*a-d*, respectively. It will be appreciated that the inner stops 152*a-d* may be machined as part of the border manufacturing process above. With the glazing assembly in place against the inner stops, the outer stops 182*a-d* may be added and secured to the corresponding overlay.

At step 624, weatherstripping components 241*a-d* and 243 may be added to the inner and outer sub-assemblies 110, 210 as preferred.

For installation purposes, the sub-assemblies may remain separate, transported to the installation site, and then installed there as shown in steps 626 and 628. In such case, the outer sub-assembly 210 would be secured to the exposed frame of the building 104 within the rough opening 102 (FIGS. 1B-1C), the surrounding areas sealed off, and the inner sub-assembly 110 then affixed to the outer sub-assembly to complete the composite fenestration installation.

Figure 16:
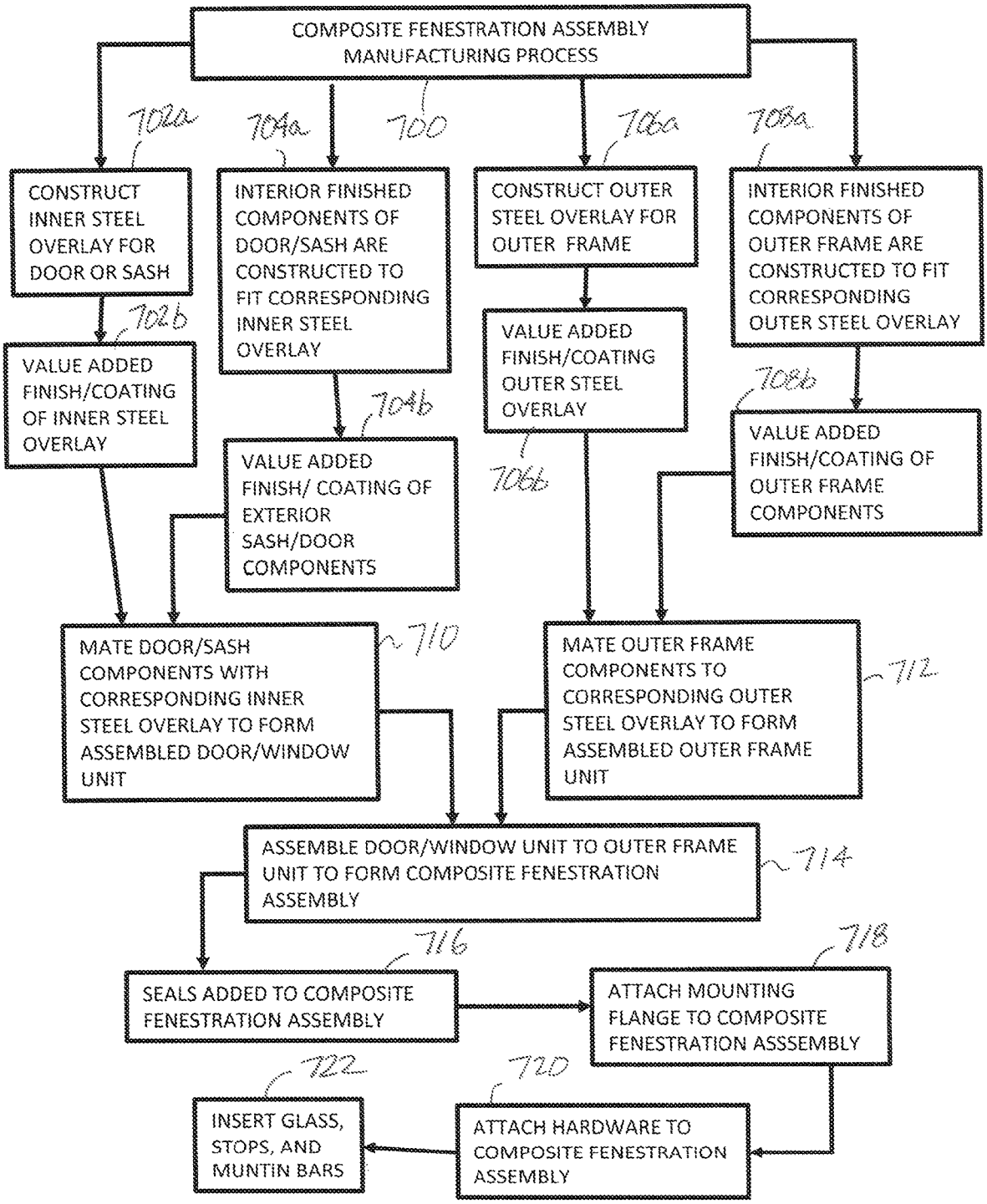
FIG. 16 is a process diagram illustrating another exemplary manufacturing process.

Turning now to FIG. 16, another exemplary process, generally designated 700, will now be described. In this example, it will be assumed that the specifications and condition of the rough opening and site lighting requirements are known either through an on-site inspection or per plans. Construction and assembly of an exemplary window unit 100 are used for this description. Starting with step 702*a*, the steel overlay 114 for the window sash 112 (or door) is constructed by assembling and welding the four inner steel (angle iron) overlay components 160, 162, 164, and 166 together at their respective corners. At step 702*b*, a finish or coating may be applied to the inner overlay 114. At step 704*a*, the sash components 116, 118, 120, and 122 selected from a second material are constructed or machined to closely fit their corresponding inner overlay components 160, 162, 164, 166, respectively. At this point, it is assumed that the interior surfaces of the sash components have been finished. At step 704*b*, a finish coating may be applied to the exterior surfaces of the sash components 116, 118, 120, and 122. At step 706*a*, the outer overlay components 260, 262, 264, and 266 are assembled together and welded together where the components meet at their respective corners to form the outer overlay 214. At step 706*b*, a finish or coating is applied to the outer overlay 214. At step 708*a*, the outer frame components 216, 218, 220, and 222 also selected from a second material are constructed or machined to closely fit their corresponding outer overlay components 260, 262, 264, 266, respectively. At this point, it is assumed that the interior surfaces of the outer frame components have been finished. At step 708*b*, a finish or coating may be applied to the outer frame components 216, 218, 220, and 222. Although it is preferred to manufacture the ferrous based metal overlays 114, 214 first as these provide a sturdy frame in which to insert the wooden or other second material frame components, this is not meant to be limiting and it will be appreciated that each of the steps 702*a-b*. 704*a-b*. 706*a-b*, and 708*a-b* may be conducted in parallel or sequentially.

With continued reference to FIG. 16, at step 710, the sash 112 is mated or married to the inner steel overlay 114 to form an inner sub-assembly 110. The sash may be either fully assembled before marrying to the inner steel overlay or married component by component. A layer of adhesive marries the two sections 112, 114 together. If additional fasteners are required, they may be added. At step 712, the outer frame 212 is mated or married to the outer steel overlay 214 to form an outer sub-assembly 210. The outer frame may be either fully assembled before marrying to the outer steel overlay or married component by component. A layer of adhesive marries the two sections 212, 214 together. If additional fasteners are required, they may be added. It will be appreciated that steps 710, 712 may be performed in parallel or sequentially.

With continued reference to FIG. 16, at step 714, the inner sub-assembly 110 may be connected to the outer sub-assembly 210. Seals and other weatherstripping components may be added at step 716 followed by the addition of the mounting flanges 197*a-c* around the periphery of the outer sub-assembly 210 in step 718. The operating hardware such as hinges, latches, crank handles, friction stays, and the like may be added at step 720. In step 722, the glass unit 142 may be inserted into the aligned glazing openings 124, 167 and then the inner stops 134*a-d* and outer stops 182*a-d* followed by the muntin bars 500*a*. 500*b* (FIG. 14), if used, to form a completed composite fenestration assembly 100 ready for insertion and connection to the building structure 104.

It will be appreciated that such process as shown in FIG. 16 may be used for a door or a window construction and assembly with only minor modifications, especially in the sill or threshold areas. One of ordinary skill in the art would understand how to install the door threshold. In addition, the order of the steps is meant to be exemplary and not limiting as, for example, the seals, mounting flanges, hardware, glass, stops, and muntins may be added prior to final assembly of the composite fenestration assembly or in a different order as the manufacturer determines.

While the interior surfaces of the overlays in the embodiments discussed herein generally have no opposing surfaces, it will be appreciated that opposing surfaces may be employed as, for example, the inner overlay member 360 shown in FIG. 10, However, even with such construction, the overlay member is rigid and may be slip fit onto a corresponding border member without flexing unlike the aluminum cladding constructions that incorporate a clamping construction requiring the flexibility of aluminum to accommodate assembly.

It will further be appreciated that the technical solution provided herein to mate a ferrous based material with a non-ferrous based material to construct, assemble, and install requires the skills of both a woodworker and a metal worker, two very distinct skill and tool sets.

Alternatively, the sub-assemblies 110, 210 or 310, 410 may be assembled together and transported to the installation site. In such case, the outer sub-assembly is secured to the exposed building frame within the rough opening. As the inner sub-assembly is already secured to the outer sub-assembly, the only remaining step is to finish the area surrounding the rough opening to waterproof and close off any openings between the interior and exterior of the building structure.

Regardless of either installation process (pre-assembled sub-assemblies or in situ), the mounting hardware as, for example, hinges, nail fins, and the like may be added to around the peripheries of the inner and outer sub-assemblies 110, 210, or 310, 410 as required by the site specifications. Operational hardware such as cranks, levers, stays, balances, locks, and the like may also be added, as necessary.

As used throughout this disclosure, glazing is the glass portion of window or door and shall apply to a transparent, opaque, or translucent viewing panel, glass, pane, or the like whereas pane shall refer to a single piece of glass within a window or door. However, it will be appreciated that the panes of glass may be divided into lites or lights, with divided lites or true divided lites (TDLs) being separately framed pieces or panes of glass. Designs simulating the appearance of separately-framed panes are often referred to as simulated divided lites (SDLs). A lite is a piece of glass, typically separately framed. A fixed light of fixed light opening as defined in this disclosure is a window that does not open.

As defined in this disclosure, a sightline is visual feature of a window or door that measures the amount of frame viewable by an observer. For a given sized door or window, a narrower sightline means that more of the glass panel is exposed.

The terms "left", "right", "top", "bottom", "upper", "lower", "vertical", "horizontal", "front", "back", and "side" are relative terms used throughout the to help the reader understand the figures. Unless otherwise indicated, these do not denote absolute direction or orientation and do not imply a particular preference. Any specific dimensions provided herein are intended to help the reader understand the scale and advantage of the disclosed material. Such dimensions given are typical and the claimed invention is not limited to the recited dimensions.

It will be appreciated that while a rectangular composite fenestration assembly with four sides has been described herein, other shapes may be accommodated simply by altering the shape of the borders and their respective overlays. Circular portals, triangular, square, and irregular, non-geometric shapes are contemplated to fall within this disclosure. Typically, the window borders will be constructed with opposing stiles, head, and sill while door borders constructed of opposing top and bottom rails and opposing stiles, but this is not meant to be limiting and other configurations will occur to one of ordinary skill in the art. Along these lines, the composite fenestration assembly may include a border, frame, or overlay with a gap having a different construction as, for example, the door threshold as described above.

It will further be appreciated that the overlay, border, and frame openings generally align. However, such alignment may be coplanar, parallel, offset, or substantially aligned and does not require an exact matching alignment in the same plane. The opening of one component may be greater or lesser than another. For example, the opening defined by the outer frame is generally greater than the opening of the glazing border from the interior to the exterior, top to the bottom, and left to the right so as to accommodate insertion of the inner sub-assembly. In general, the orientation of the openings defined by the overlays, borders, and/or frame merely cooperate to define a fenestration with a viewing window or pane having one or more sightlines that are preferably not obstructed by the overlays.

It will be appreciated that the composite fenestration assembly may be used in new construction and also to retrofit a building once the prior window assembly is removed and the rough opening prepared. The composite fenestration assembly may be manufactured and assembled in a remote location and transported to the installation or job site for final installation as a completed assembly or may be partially assembled remotely and then fully assembled at the site during final installation.

While the foregoing has been described in terms of an inner sub-assembly and an outer sub-assembly that may cooperate to define a complete composite fenestration assembly, it will be appreciated that the inner sub-assembly alone is within the scope of this disclosure as, for example, a direct-set window in which the inner sub-assembly provides both the glazing and the frame that may be secured directly to the rough opening framing. In addition, the inner sub-assembly may be constructed in a different manner than the outer sub-assembly.

Certain objects and advantages of the invention are described herein. Of course, it is to be understood that not necessarily all such objects or advantages may be achieved in accordance with any particular embodiment. Thus, for example, those skilled in the art will recognize that the invention may be embodied or carried out in a manner that achieves or optimizes one advantage or group of advantages as taught herein without necessarily achieving other objects or advantages as may be taught or suggested herein.

While various exemplary embodiments and processes have been described for purposes of this disclosure, such embodiments should not be deemed to limit the teaching of this disclosure to those embodiments. Various changes, additions, substitutions, and modifications may be made to the elements and operations described above to obtain a result that remains within the scope of the systems and processes described in this disclosure.

What is claimed is:

1. A composite fenestration assembly constructed of at least two different materials for securing within a rough opening separating an interior of a structure from an exterior, the assembly comprising:

a glazing border constructed of a non-ferrous material and defining at least one glazing opening, the glazing border including a decorative surface and a glazing opening facing surface adjacent an exposed surface turning outwardly away from the glazing opening and facing in a different direction than the decorative surface; and an inner overlay constructed of a rigid ferrous material including a first leg section projecting in a first direction and a second leg section projecting from the first leg section in a different direction and away from the glazing opening, the sections together defining an interior facing surface complementary to at least a portion of the combined glazing opening facing surface and the exposed surface, the leg sections being slipped onto the glazing border without flexing to cover at least a portion of the glazing opening facing surface and at least a portion of the exposed surface of the glazing border in an abutting relationship and define a second opening aligned with the glazing opening to form a combined glazing border and inner overlay assembly.

2. The composite fenestration assembly of claim 1 wherein:

the non-ferrous material is wood and the ferrous material is steel.

3. The composite fenestration assembly of claim 1 wherein:

the inner overlay is constructed of one or more sections of angle iron welded together where the sections meet to define a structurally integral frame.

4. The composite fenestration assembly of claim 1 wherein:

the glazing border includes at least one upright member and at least one laterally projecting member when positioned within the rough opening; and the inner overlay includes at least one upright member corresponding to the at least one upright member of the glazing border and at least one laterally projecting member corresponding to the at least one laterally projecting member of the glazing border.

5. The composite fenestration assembly of claim 1 wherein:

the thermal coefficient of the non-ferrous material is lower than the thermal coefficient of the ferrous material.

6. The composite fenestration assembly of claim 1 wherein:

the second leg section projects from the first leg section at an angle ranging from a right angle up through an obtuse angle.

7. The composite fenestration assembly of claim 1 further comprising:

at least one layer of structural adhesive between the interior surface of the inner overlay abutting at least a portion of the combined glazing opening facing surface and the exposed surface with no unfilled air gaps therebetween.

8. The composite fenestration assembly of claim 1 wherein:

the first leg section of the inner overlay is of different length than the second leg section of the inner overlay.

9. The composite fenestration assembly of claim 1 wherein:

the inner overlay is constructed of a quarter-inch L-angle metal alloy.

10. The composite fenestration assembly of claim 1 wherein:

at least one of the leg sections of the overlay includes an outermost extent facing away from the glazing opening that covers the entire adjacent outwardly facing exposed surface.

11. The composite fenestration assembly of claim 1 wherein:

the combined glazing border and inner overlay present an outwardly facing ferrous based exterior surface and a non-ferrous decorative surface facing into the interior of the structure when the combined border and overlay are installed in the rough opening of the structure.

12. The composite fenestration assembly of claim 1 wherein:

the inner overlay members are solid throughout and unbroken from an outer edge of the first leg section to a distal edge of the second leg section.

13. The composite fenestration assembly of claim 1 wherein:

the first leg section of the inner overlay has a smooth planar interior surface; and the second leg section of the inner overlay has a smooth planar interior surface.

14. The composite fenestration assembly of claim 1 wherein:

the glazing border includes a pair of opposing rails and a pair of opposing stiles.

15. The composite fenestration assembly of claim 1 wherein:

the glazing border includes a transition having a first profile between the glazing opening facing surface and the exposed surface; and the inner overlay includes an interior surface with a matching transition between the first and second leg sections.

16. The composite fenestration assembly of claim 1 further comprising:

at least one glazing secured within the glazing opening between opposing glazing opening facing surfaces; and at least one first leg section of the inner overlay extends between the outermost extent of the glazing and the most proximate glazing opening facing surface.

17. The composite fenestration assembly of claim 16 further comprising:

at least one external glazing stop to inhibit the glazing from moving in a first direction relative to the glazing border; and at least one internal glazing stop to inhibit the glazing from moving in an opposite direction relative to the glazing border.

18. The composite fenestration assembly of claim 16 further comprising:

at least one muntin creating subdivisions along the surface of the glazing.

19. The composite fenestration assembly of claim 1 wherein:

the inner overlay restricts the expansion and contraction of the glazing border.

20. The composite fenestration assembly of claim 1 wherein:

the inner overlay is a self-supporting structure.

21. A composite fenestration assembly constructed of at least two different materials for securing within a rough opening separating an interior of a structure from an exterior, the assembly comprising:

a glazing border constructed of a non-ferrous material and defining at least one glazing opening, the glazing border including a decorative surface facing into the interior of the structure when positioned within the rough opening, a glazing support surface facing toward the glazing opening, and an outwardly facing exposed surface when positioned within the rough opening;

an inner overlay constructed of a rigid ferrous material including a first leg section projecting in a first direction and a second leg section projecting from the first leg section in a different direction, the sections together defining an interior facing surface complementary to at least a portion of the combined glazing support surface and the outwardly facing exposed surface, the leg sections being slipped onto the glazing border without flexing to cover at least a portion of the glazing support surface and at least a portion of the outwardly facing exposed surface of the glazing border in an abutting relationship and define a second opening aligned with the glazing opening to form a combined glazing border and inner overlay assembly;

at least one outer border constructed of a non-ferrous material and defining at least one outer border opening constructed to receive the combined glazing border and inner overlay assembly, the outer border including a decorative surface facing into the interior of the structure when positioned within the rough opening, an inner assembly surface facing toward the outer border opening, and an outwardly facing exposed surface when positioned within the rough opening; and a rigid outer overlay constructed of a ferrous material including a solid first leg section projecting in a first direction and a solid second leg section projecting from the first leg section in a different direction, the leg sections together defining an interior facing surface complementary to at least a portion of the combined inner assembly surface and the outwardly facing exposed surface, the leg sections being slipped onto the outer border without flexing to cover at least a portion of the inner assembly surface and at least a portion of the outwardly facing exposed surface of the outer border in an abutting relationship to define a combined outer border and outer overlay assembly with an inner assembly opening aligned with the glazing opening of the glazing border with the combined outer border and outer overlay frame assembly being constructed to be secured to the building structure within the rough opening with the combined glazing border and overlay assembly secured to the combined outer border and outer overlay assembly.

22. The composite fenestration assembly of claim 21 wherein:

the borders are constructed of wood; and the overlays are constructed of angle iron.

23. The composite fenestration assembly of claim 21 wherein:

at least one of the borders includes a relief cut to accommodate recessing a portion of the respective overlay.

24. The composite fenestration assembly of claim 21 wherein:

at least one exterior facing surface of the inner overlay is coplanar with at least one exterior facing surface of the outer overlay.

25. The composite fenestration assembly of claim 21 wherein:

at least one glazing support surface of the inner overlay is parallel to at least one inner assembly surface of the outer overlay.

26. The composite fenestration assembly of claim 21 wherein:

at least one border includes a pair of upright jambs, a head, and an opposing sill when installed within the rough opening.

27. The composite fenestration assembly of claim 21 wherein:

at least one overlay includes a pair of upright stiles and at least one rail.

28. A composite fenestration assembly constructed of at least two different materials for securing within a rough opening separating an interior of a structure from an exterior, the assembly comprising:

a first border constructed of a non-ferrous material and having at least one glazing opening, the first border including one or more glazing support surfaces facing toward the glazing opening and an outwardly facing exposed surface when positioned within the rough opening;

at least one glazing secured within the glazing opening; and a first overlay constructed of a rigid ferrous material with the first overlay including a first leg section projecting in a first direction and a second leg section projecting from the first leg section in a different direction, the leg sections together defining a first profile with an interior facing surface constructed to slip onto and be affixed to the first border without flexing in an abutting relationship to match at least a portion of the combined glazing support opening facing surface and the outwardly facing exposed surface and define a first sub-assembly with at least one first leg section of the inner overlay extending between the outermost extent of the glazing and the most proximate glazing support surface while not interfering with a set of original sight lines through the glazing.

29. The composite fenestration assembly of claim 28 further comprising:

a second border constructed of a non-ferrous material and defining at least one first sub-assembly opening, the second border including an outwardly facing exposed surface when positioned within the rough opening; and a second overlay constructed of a rigid ferrous material with the second overlay defining a second profile with an interior facing surface constructed to slip onto and be affixed to the second border without flexing in an abutting relationship to cover at least a portion of the outwardly facing exposed surface and define a second sub-assembly, the second sub-assembly being constructed to secure the first sub-assembly within the rough opening of the structure.

* * * * *